US011499506B2

(12) United States Patent
Ninomiya et al.

(10) Patent No.: US 11,499,506 B2
(45) Date of Patent: Nov. 15, 2022

(54) OPENING/CLOSING MECHANISM OF INTAKE MEMBER

(71) Applicant: HONDA MOTOR CO., LTD., Tokyo (JP)

(72) Inventors: Yusuke Ninomiya, Wako (JP); Yuji Oigawa, Wako (JP); Tetsuya Ogawa, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 322 days.

(21) Appl. No.: 16/641,111

(22) PCT Filed: Mar. 5, 2019

(86) PCT No.: PCT/JP2019/008669
§ 371 (c)(1),
(2) Date: Feb. 21, 2020

(87) PCT Pub. No.: WO2020/178986
PCT Pub. Date: Sep. 10, 2020

(65) Prior Publication Data

US 2021/0140392 A1 May 13, 2021

(51) Int. Cl.
*F02M 1/02* (2006.01)
*F02M 19/12* (2006.01)
(Continued)

(52) U.S. Cl.
CPC ..... *F02M 1/02* (2013.01); *F02M 35/02416* (2013.01); *F02M 35/10209* (2013.01)

(58) Field of Classification Search
CPC .... F02M 1/02; F02M 19/12; F02M 35/02416; F02M 35/0209; F02M 35/10209; F02M 35/10196; F02M 35/1017
See application file for complete search history.

(56) References Cited

U.S. PATENT DOCUMENTS 4,841,929 A * 6/1989 Tuggle ..... F02B 63/02 123/185.3
6,070,487 A 6/2000 Beugelsdyk et al.
(Continued)

FOREIGN PATENT DOCUMENTS

DE 3876395 T2 5/1993
EP 0320576 B1 6/1989
(Continued)

OTHER PUBLICATIONS

European Search Report dated Aug. 3, 2020, 8 pages.
Taiwanese Office Action dated Nov. 19, 2020, 10 pages.

*Primary Examiner* — Grant Moubry
(74) *Attorney, Agent, or Firm* — Rankin, Hill & Clark LLP

(57) ABSTRACT

An opening/closing mechanism of an intake member includes: an intake member that accommodates a filter part and has an opening leading to a carburetor in an end wall opposing the filter part; an opening/closing member disposed between the filter part and the end wall, and opens/closes the opening; and a working member disposed on an opposite side to the opening/closing member so as to interpose the end wall, and allows the opening/closing member to be operated. The working member includes: an arm part which extends along the end wall and is linked with the opening/closing member to interpose the end wall at one end part, and a holding part provided to another end part of the arm part. The intake member has a guide hole into which the arm part is inserted and guides movement of the arm part.

9 Claims, 29 Drawing Sheets

(51) Int. Cl.
*F02M 35/024* (2006.01)
*F02M 35/10* (2006.01)

(56) References Cited

U.S. PATENT DOCUMENTS

| | | | | |
|---|---|---|---|---|
| 10,480,427 | B2 | 11/2019 | Ishikawa et al. | |
| 2010/0192928 | A1 | 8/2010 | Yuasa | |
| 2010/0237516 | A1* | 9/2010 | Kern | F02D 11/04 261/64.6 |
| 2014/0000542 | A1* | 1/2014 | Karrar | B27B 17/083 123/179.3 |
| 2014/0102241 | A1 | 4/2014 | Rao et al. | |
| 2014/0299095 | A1* | 10/2014 | Arai | F02P 5/1506 123/343 |
| 2016/0265429 | A1* | 9/2016 | Enriquez | F02M 1/02 |
| 2017/0167412 | A1 | 6/2017 | Ishikawa et al. | |
| 2018/0119647 | A1* | 5/2018 | Schulz | F02B 63/02 |
| 2018/0347490 | A1* | 12/2018 | Kuroiwa | F02D 17/04 |
| 2019/0024611 | A1* | 1/2019 | Wykman | F02M 1/02 |

FOREIGN PATENT DOCUMENTS

| | | | | |
|---|---|---|---|---|
| JP | 57-193950 | | 2/1981 | |
| JP | 2-87952 | | 7/1990 | |
| JP | 2-132836 | | 11/1990 | |
| JP | 2526276 | | 11/1996 | |
| JP | 2714409 | B2 | 2/1998 | |
| JP | 2001-55958 | | 2/2001 | |
| JP | 2001-90608 | | 4/2001 | |
| JP | 2002349298 | A * | 12/2002 | F02D 11/04 |
| JP | 2007-56758 | | 3/2007 | |
| JP | 2010-174773 | | 8/2010 | |
| JP | 5702445 | B2 * | 4/2015 | |
| JP | 6386438 | | 8/2018 | |

* cited by examiner

OPENING/CLOSING MECHANISM OF INTAKE MEMBER

TECHNICAL FIELD

The present invention relates to an opening/closing mechanism of an intake member.

BACKGROUND ART

Conventionally, an all-purpose engine has been known which can be used as a drive source of small-scale work machine such as a weed trimmer, for example. With such a weed trimmer, an all-purpose engine can be mounted to a base end of a drive shaft to which a blade is attached to a leading end. The all-purpose engine is a two-stroke or four-stroke engine which drives a piston by causing a mixture of fuel and air to combust. In such an all-purpose engine, an air cleaner for intake air to a carburetor is provided (for example, refer to Patent Document 1).

The air cleaner sends the intake air (air) having passed through the air filter accommodated in the air cleaner case, for example, to the carburetor via an opening provided in an end wall of the air cleaner case. Herein, an opening/closing mechanism which adjusts the fuel ratio relative to intake air by adjusting the intake amount sent to the carburetor by opening/closing the opening is provided to the air cleaner case. The opening/closing mechanism has: a choke valve which is opening/closing member that is arranged at an air-filter side of an end wall of the air cleaner case, and opens/closes the opening to the carburetor; and a choke lever which is a working member arranged on the opposite side to the air filter of the end wall of the air filter case, and causes the choke valve to operate.

The choke lever integrally includes a holding part which extends to one side of the air cleaner case along the end wall, and is held upon being moved and manipulated to one direction (for example, up/down direction) by the hand (finger) of an operator. Generally, the holding part is provided to be wider than an arm part of the choke lever, and is integrally molded with the arm part from resin, for example.

Patent Document 1: Japanese Patent No. 6386438

DISCLOSURE OF THE INVENTION

Problems to be Solved by the Invention

In order to stably perform a moving manipulation of the choke lever, by providing a narrow slit-shaped guide hole to the air cleaner case, and inserting the arm part of the choke lever into the guide hole to be sandwiched, it is desirable to guide and position the moving manipulation of the choke lever along the guide hole. In this case, the choke lever is installed to the air cleaner case, by inserting the arm part into the guide hole from an end part on the opposite side to the holding part.

Herein, a connecting with the all-purpose engine main body (for example, cylindrical boss part for returning air containing oil blown back to the side of the air cleaner case from the side of the carburetor to the side of the carburetor from the opening) is provided to the air cleaner case to project from the same surface as the installation surface of the choke lever. In particular, by also making the cleaner case compact in order to achieve compactness of the all-purpose engine, when the connecting part is arranged within the movement range of the choke lever or so as to approach the movement range, and inserting the choke lever from the guide hole, the arm part of the choke lever and the connecting part tend to interfere. For this reason, upon installing the choke lever through the guide hole, it is necessary to insert while tilting the side of the holding part of the choke lever in a direction orthogonal to the movement direction during manipulation of the choke lever, i.e. opposite direction to the projecting direction of the connection, so as to avoid the connecting part projecting from the air cleaner case, i.e. so that the arm part overcomes the connecting part.

However, upon tilting the side of the holding part of the choke lever, the holding part will interfere with the air cleaner case, and it is not easy for the arm part to overcome the connecting part, and thus there is problem in that the workability upon mounting the choke lever is poor. This is because, in order to improve the operability, the holding part of the choke lever is formed so as to extend in the width direction intersecting the movement direction of the arm part.

In this case, by lengthening the arm part of the choke lever, although it is possible to avoid interference between the holding part and air cleaner case, since the holding part side of the choke lever will greatly protrude to the outer side of the air cleaner case, the air cleaner case having the choke lever will increase in overall size by this amount, and it will become difficult to satisfy the demand for compactness of all-purpose engines.

The present invention has been made taking account of the above, and an object thereof is to provide an opening/closing mechanism of an intake member which can improve the mounting property of the working member for which the movement manipulation is guided by the guide hole.

Means for Solving the Problems

A first aspect of the present invention provides: opening/closing mechanism (for example, the opening/closing mechanism 6A described later) of an intake member, including: an intake member (for example, the air cleaner case 61 described later) which accommodates a filter part (for example, the air filter 62 described later) and has an opening (for example, the opening 613 described later) leading to a carburetor (for example, the carburetor 60 described later) in an end wall (for example, the end wall 611 described later) opposing the filter part; an opening/closing member (for example, the choke valve 64 described later) which is disposed between the filter part and the end wall, and opens/closes the opening; and a working member (for example, the choke lever 65 described later) which is disposed on an opposite side to the opening/closing member so as to interpose the end wall, and allows the opening/closing member to be operated, in which the working member includes: an arm part (for example, the arm part 651 described later) which extends along the end wall and is linked with the opening/closing member to interpose the end wall at one end part (for example, the one end 651*c* described later), and a holding part (for example, the holding part 652 described later) provided to another end part (for example, the other end 651*d* described later) of the arm part; in which the intake member has a guide hole (for example, the guide hole 66 described later) into which the arm part is inserted and guides movement of the arm part; and the holding part is disposed to project more than the guide hole, is provided to be wider than the arm part, and has a notch part (for example, the notch part 654 described later) at a surface opposing the side wall of the intake member.

According to the first aspect, it is possible to provide an opening/closing mechanism of an intake member which can improve the mounting property of a working member for which a moving manipulation is guided by a guide hole.

According to a second aspect of the present invention, in the opening/closing mechanism of an intake member as described in the first aspect, it is preferable for a covering part (for example, the cover 63 described later) which covers an outer side of the intake member to be disposed at an opposite side to the end wall so as to interpose the filter part, and the holding part to have a planar section (for example, the planar section 655 described later) which is continuous with the notch part, at a side end (for example, the side end 652*a* described later) opposing the covering part.

According to the second aspect, it is possible to improve the mounting property while maintaining operability of the working member, due to being able to secure a clearance between the holding part and covering part.

According to a third aspect of the present invention, in the opening/closing mechanism of an intake member as described in the first or second aspect, it is preferable for the guide hole to have a positioning protrusion (for example, the positioning protrusion 663 described later) which positions the arm part to clamping upon establishing the opening in an opened state.

According to the third aspect, since the arm part of the working member is sandwiched in a state positioned within the guide hole, by the arm part moving and being limited by friction by vibration during normal running of the engine, it is possible to suppress rattling from occurring at the arm part and the opening/closing member moving, and the running state becoming unstable.

According to a fourth aspect of the present invention, in the opening/closing mechanism of an intake member as described in the third aspect, it is preferable for the guide hole to have a different size at a side (for example, upper space 66*b* described later) on which the arm part is located upon establishing the opening in a closed state, and a side (for example, the lower space 66*a* described later) on which the arm part is located upon establishing the opening in an opened state, relative to the positioning protrusion.

According to the fourth aspect, by having the size of the guide hole vary, it is possible to make the arm part of the working member to easily insert into the guide hole, while minimizing the work influence, and it is possible to improve the mounting property of the working member.

According to a fifth aspect of the present invention, in the opening/closing mechanism of an intake member as described in the fourth aspect, it is preferable for the size of the guide hole to be larger at a side on which the arm part is located upon establishing the opening in the closed state than a side on which the arm part is located upon establishing the opening in the opened state.

According to the fifth aspect, by making the side of little usage frequency in the guide hole to be larger, it is possible to clamp in a state positioning the arm part of the working member during normal use of large usage frequency within the guide hole, while improving the mounting property of the working member.

According to a sixth aspect of the present invention, in the opening/closing mechanism of an intake member as described in the fourth or fifth aspect, it is preferable for a side of the guide hole on which the arm part is located upon establishing the opening in the closed state to be an upper side in a gravity direction, and a side on which the arm part is located upon establishing the opening in the opened state to be a lower side in the gravity direction.

According to the sixth aspect, it is possible to manipulate the working member to move simply with a natural action.

According to a seventh aspect of the present invention, in the opening/closing mechanism of an intake member as described in any one of the third to sixth aspects, it is preferable for the guide hole to be formed by an internal space surrounded by two movement direction restricting parts (for example, the movement direction restricting part 661 described later) which project to an opposite side than the filter part to interpose the end wall from the intake member and restrict positions of both ends in a movement direction of the arm part, and one crossover frame part (for example, the crossover frame part 662 described later) which is provided to span the two movement direction restricting parts; and the positioning protrusion to be provided at an inner surface (for example, the inside surface 662*a*) of the crossover frame part.

According to the seventh aspect, it is possible to allow the crossover frame part side to easily elastically deform upon the arm part surpassing the positioning protrusion during movement of the working member, and possible to make operability of the working member favorable.

According to an eighth aspect of the present invention, in the opening/closing mechanism of an intake member as described in any one of the first to seventh aspects, it is preferable for the opening/closing member or the working member to have an engaging shaft (for example, the engaging shaft 644 described later) which engages with the end wall via an elastic member (for example, the O-ring 647 described later); the engaging shaft to penetrate a mounting hole (for example, the mounting hole 618 described later) of the end wall and to be inserted to an engaging hole (for example, the engaging hole 653 described later) provided in the working member or the opening/closing member; and the elastic member to be elastically sandwiched between an accommodating step part (for example, the accommodating step part 619 described later) provided to the mounting hole and the opening closing member or the working member.

According to the eighth aspect, since rattling between the working member and opening/closing member and the end wall of the intake member is suppressed by the elastic resiliency of the elastic member along the axial direction of the engaging shaft, it is possible to suppress the occurrence of abnormal noise from rattling of the working member and opening/closing member from vibration of the engine, wear, and the like.

According to a ninth aspect of the present invention, in the opening/closing mechanism of an intake member as described in any one of the first to eighth aspects, it is preferable for the intake member to have a cylindrical boss part (for example, the boss part 67 described later) which projects to an opposite side than the filter part to interpose the end wall, and constitutes a passage (for example, the communication passage 68 described later) that returns a gas returned from a side of a carburetor to the carburetor via the opening; and the boss part to be provided above the opening in the gravity direction (for example, the Z1-Z2 direction described later) of the intake member.

According to the ninth aspect, it is possible to return oil contained in a gas returning from a side of the carburetor back to the carburetor using gravity.

Effects of the Invention

According to the present invention, it is possible to provide an opening/closing mechanism of an intake member which can improve the mounting property of a working member for which movement manipulation is guided by a guide hole.

PREFERRED MODE FOR CARRYING OUT THE INVENTION

Hereinafter, an embodiment of the present invention will be explained in detail while referencing the drawings.

Figure 1:
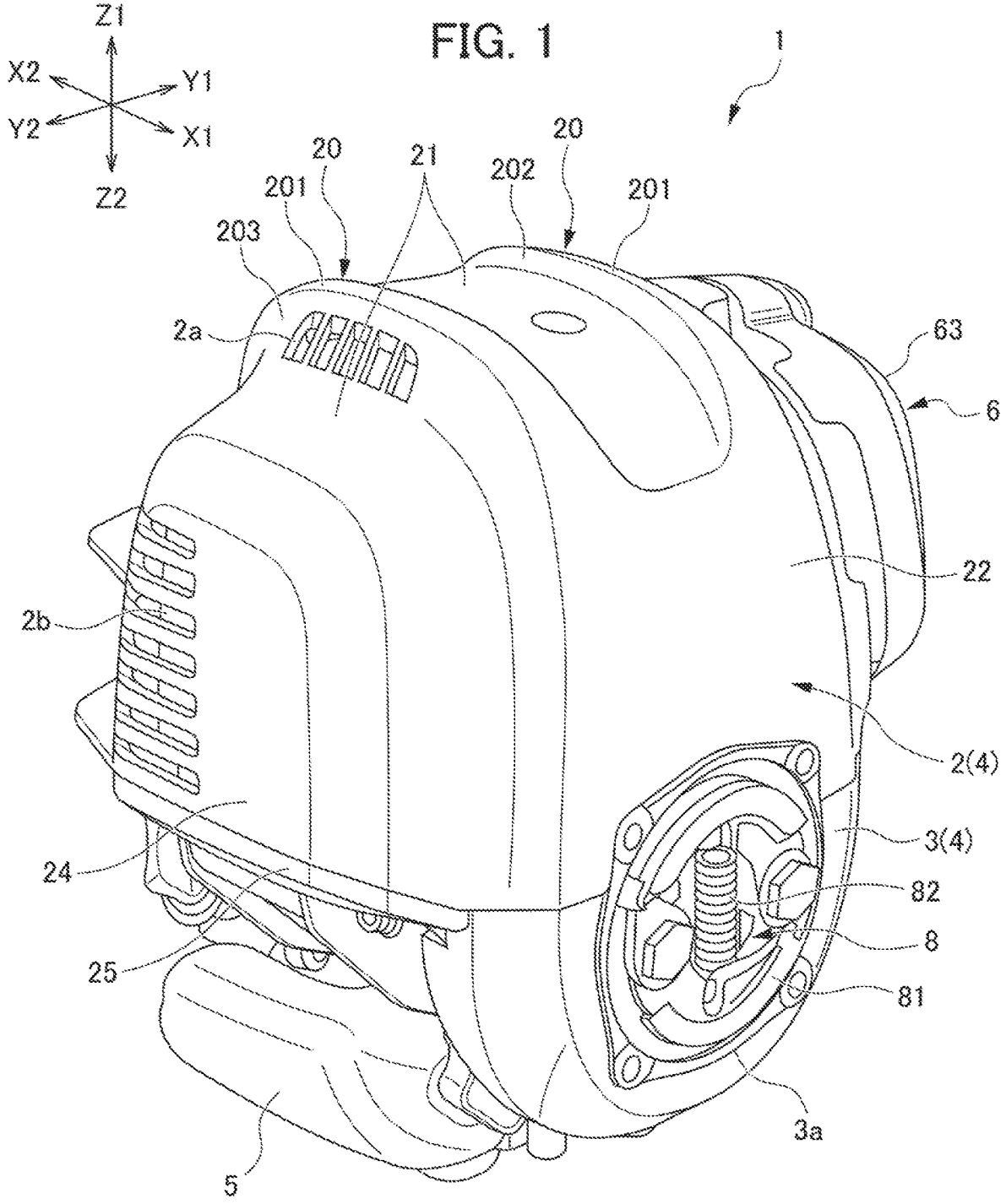
FIG. 1 is a forward perspective view of an all-purpose engine having an intake member according to an embodiment of the present invention.
Figure 2:
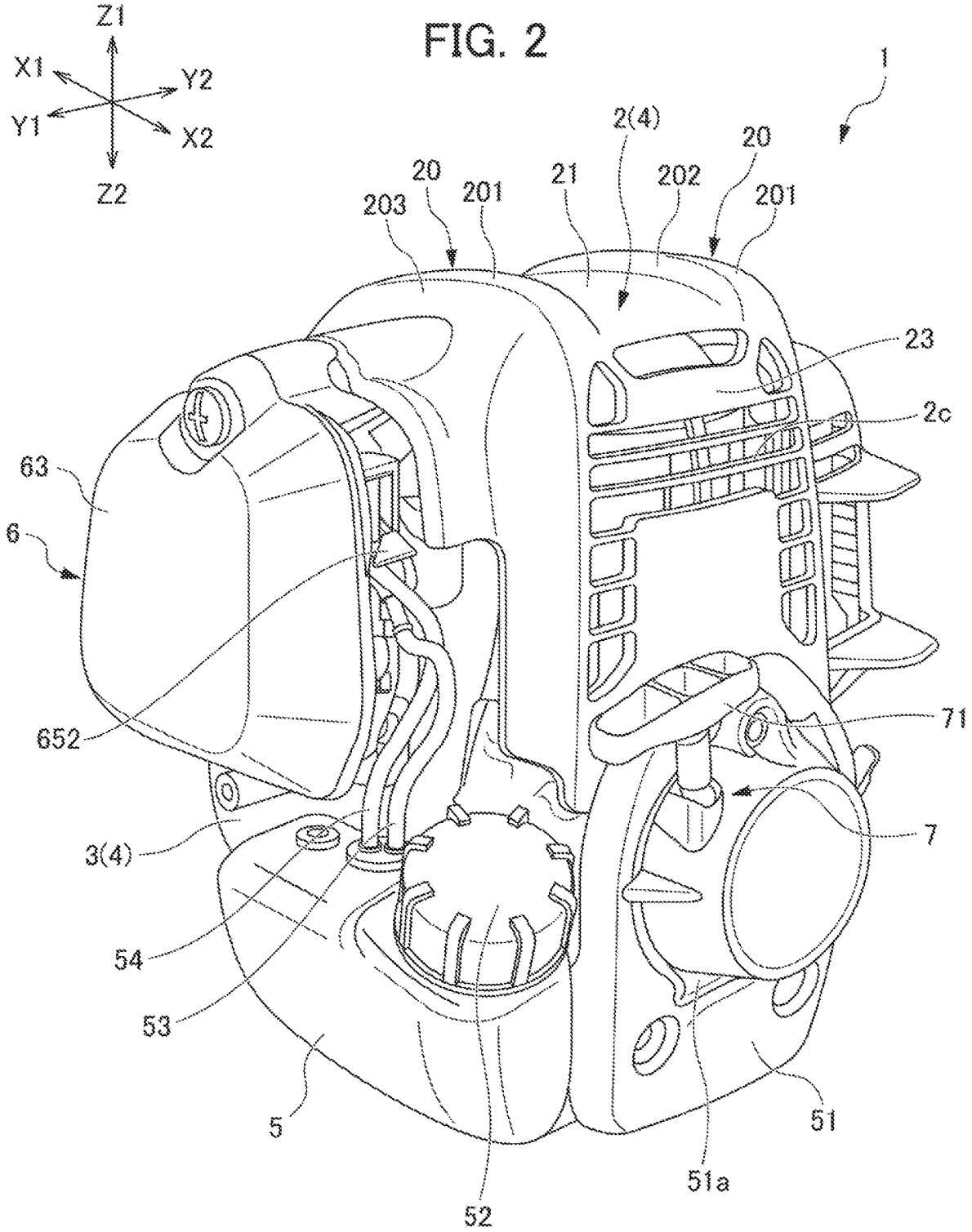
FIG. 2 is a rearward perspective view of an all-purpose engine having an intake member according to an embodiment of the present invention.
Figure 3:
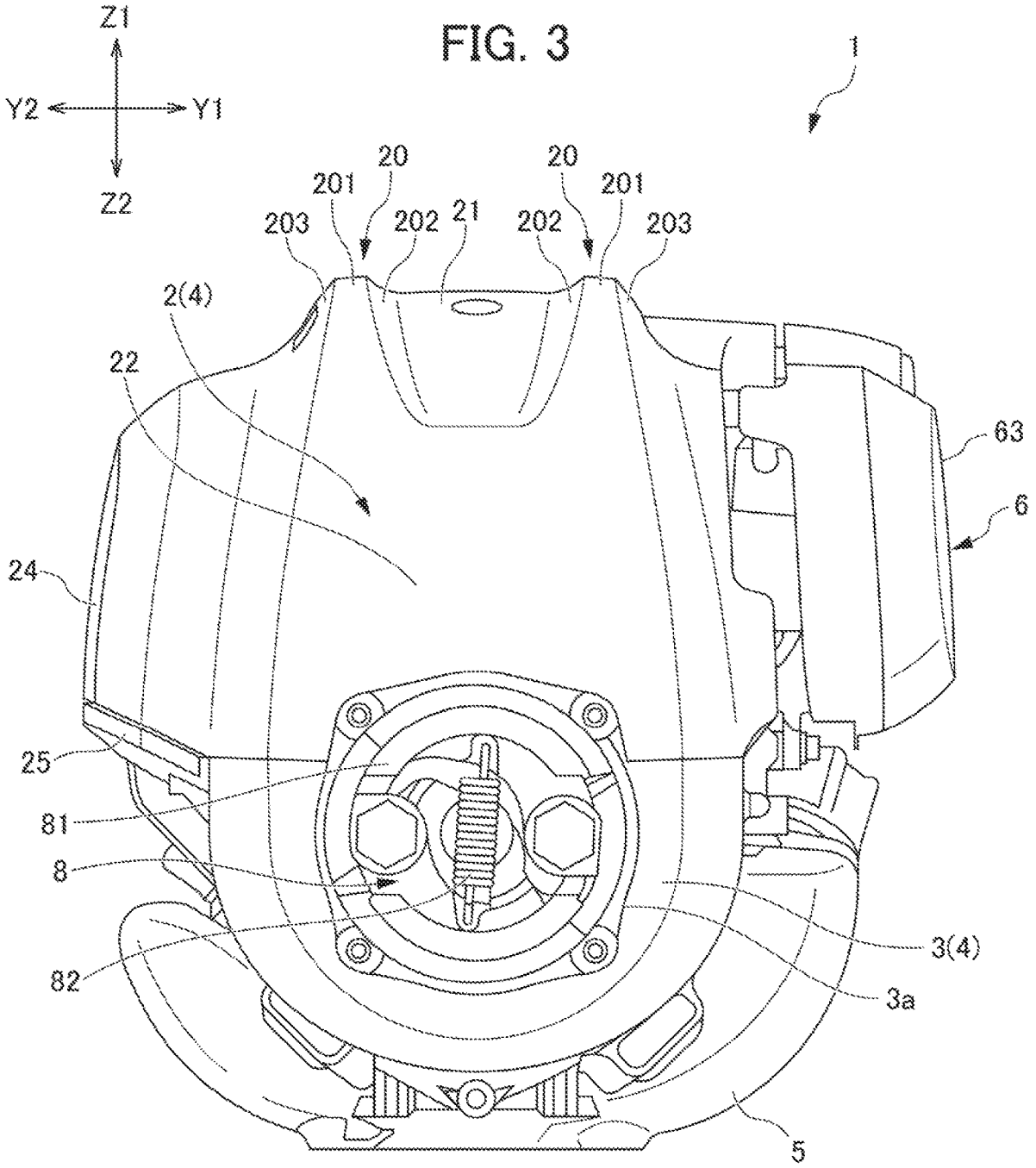
FIG. 3 is a front view of an all-purpose engine having an intake member according to an embodiment of the present invention.
Figure 4:
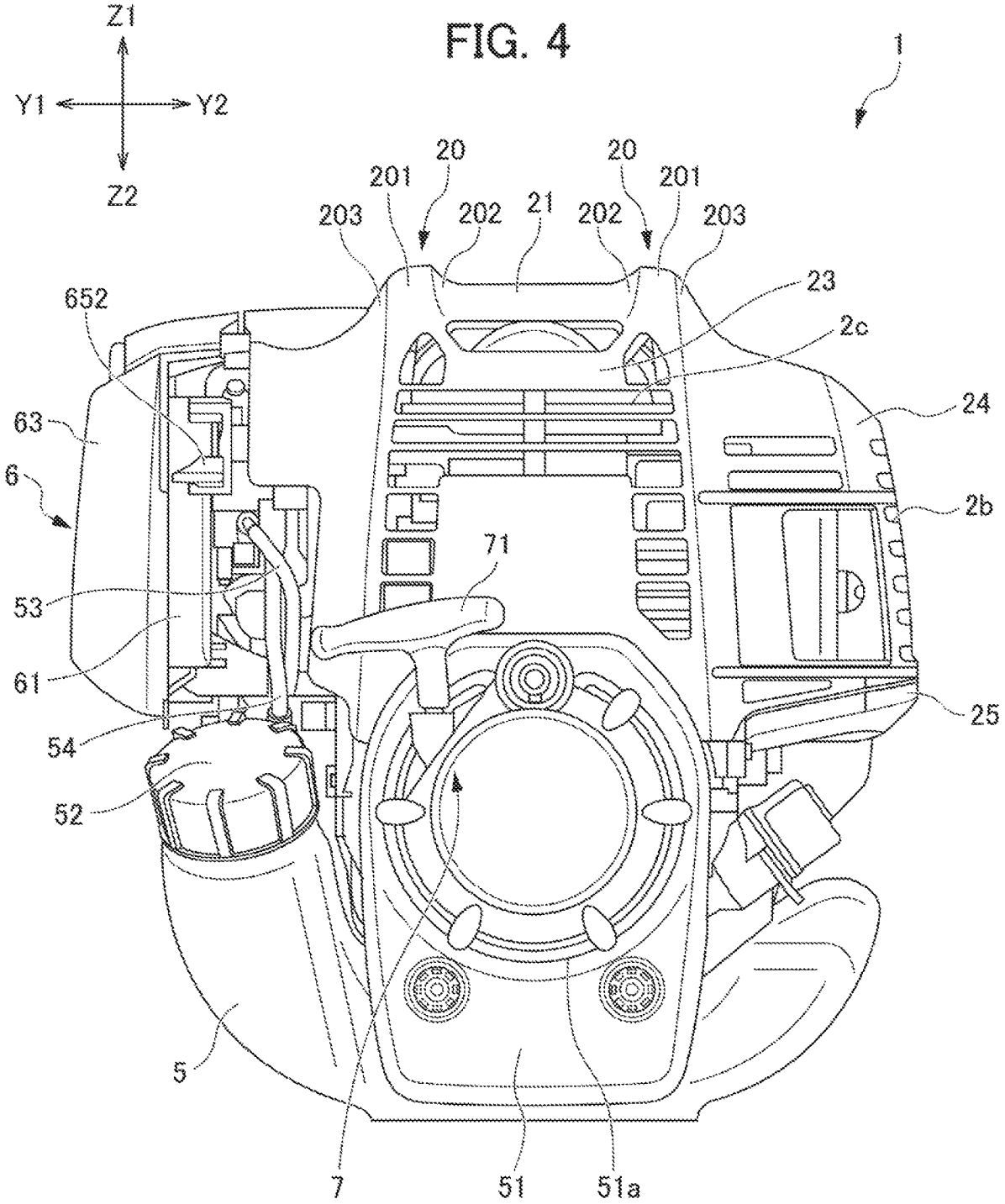
FIG. 4 is a rear view of an all-purpose engine having an intake member according to an embodiment of the present invention.
Figure 5:
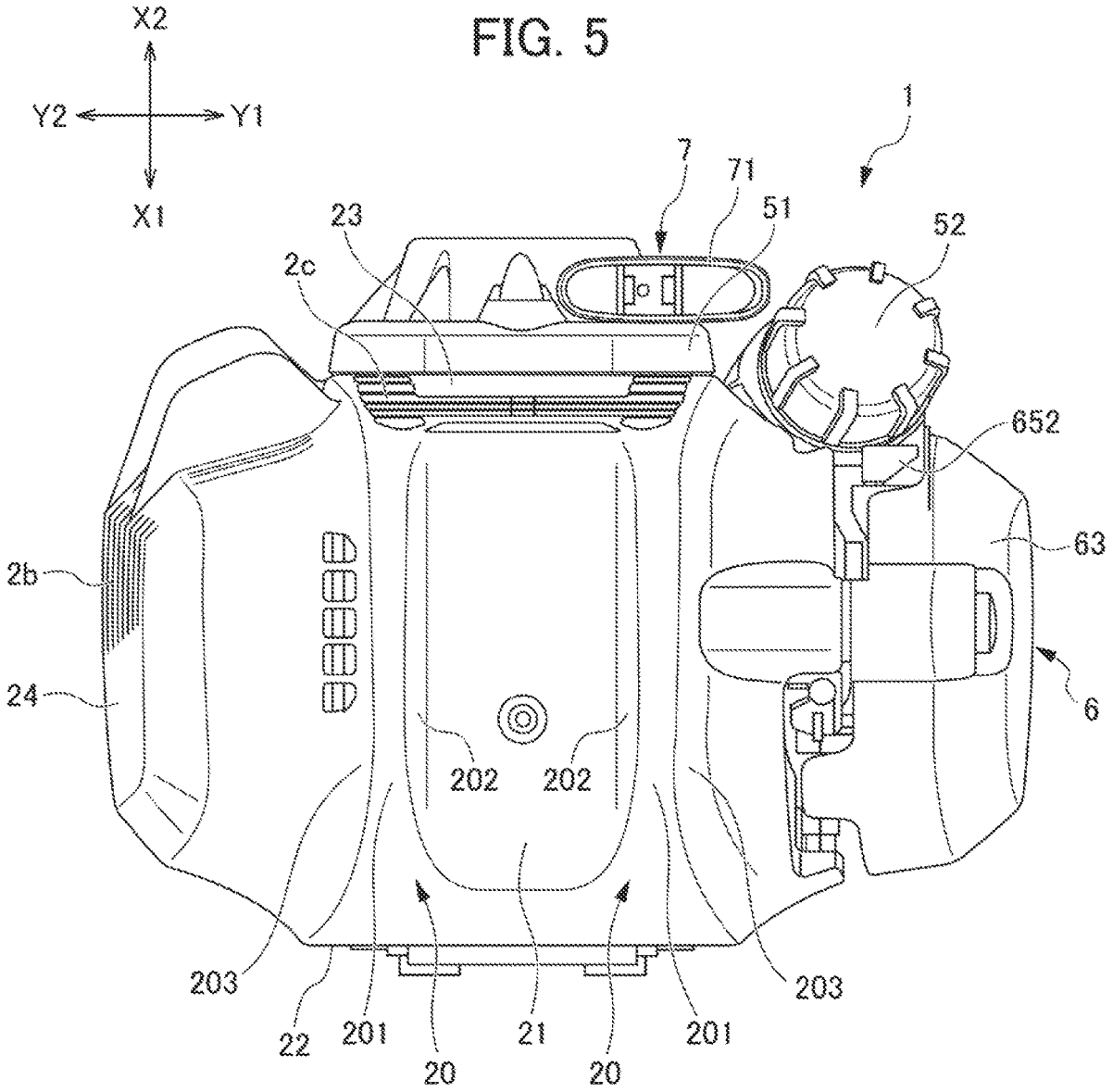
FIG. 5 is a plan view of an all-purpose engine having an intake member according to an embodiment of the present invention.
Figure 6:
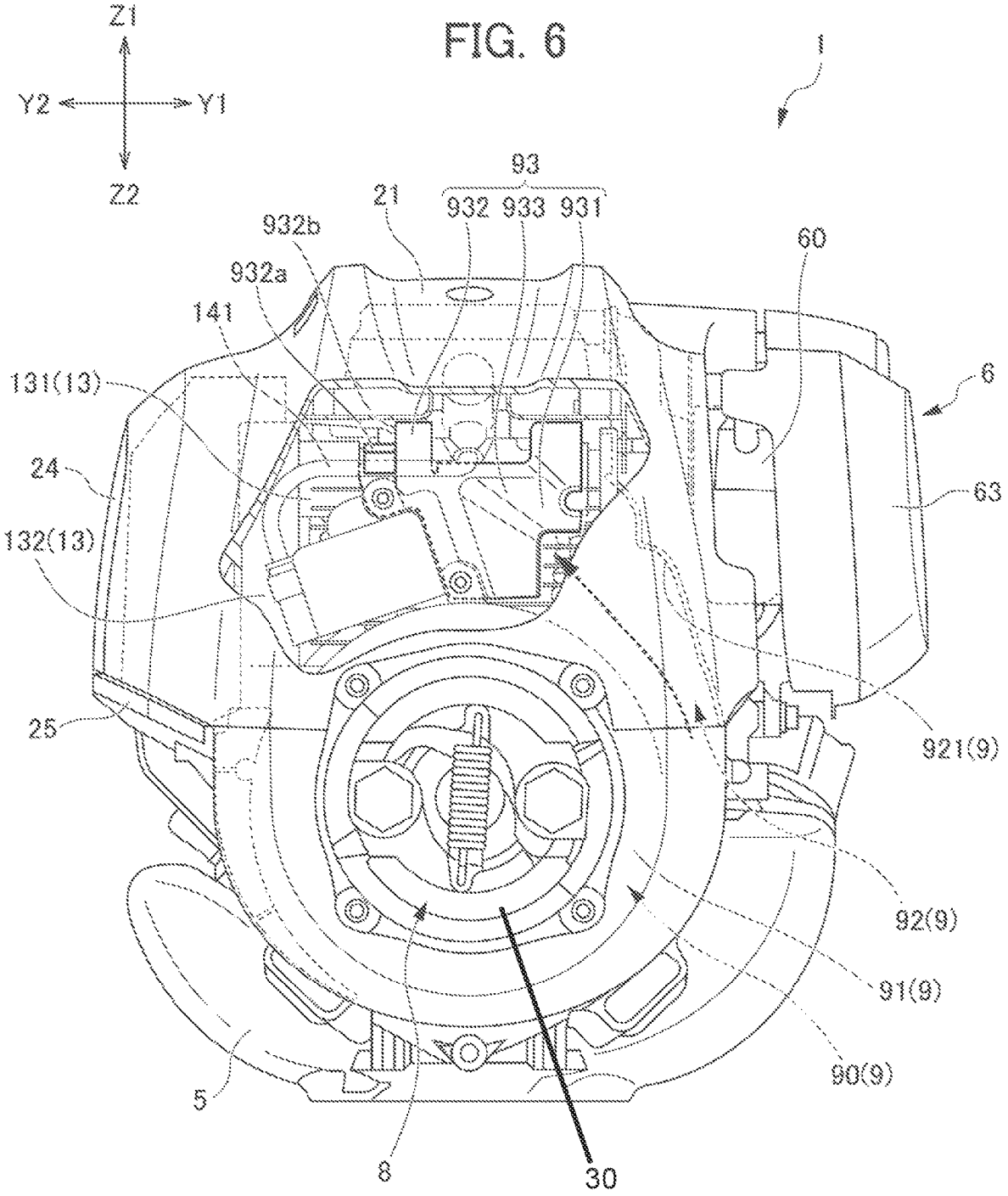
FIG. 6 is a first longitudinal sectional view of an all-purpose engine having an intake member according to an embodiment of the present invention.
Figure 7:
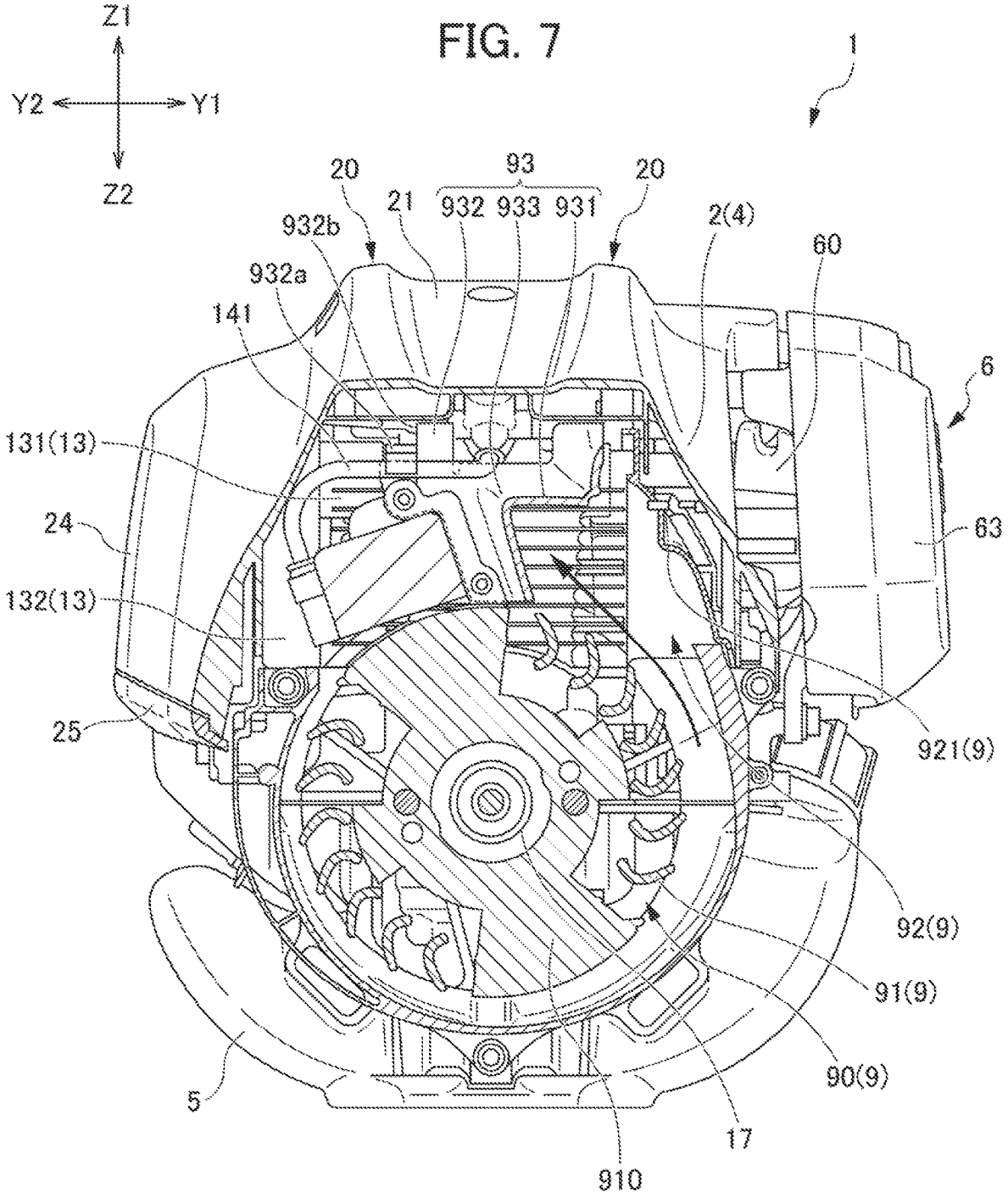
FIG. 7 is a second longitudinal sectional view of an all-purpose engine having an intake member according to an embodiment of the present invention.
Figure 8:
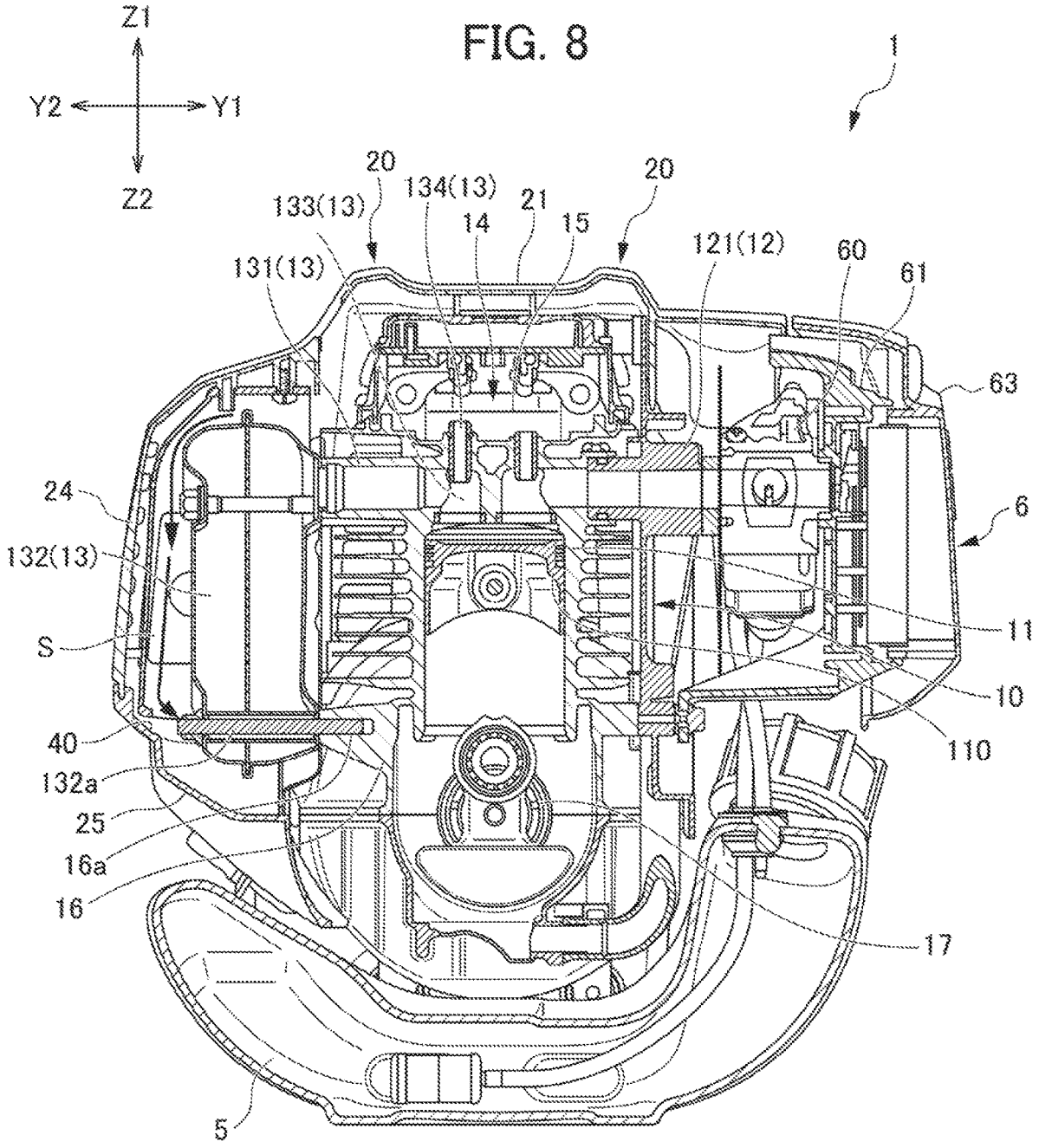
FIG. 8 is a third longitudinal sectional view of an all-purpose engine having an intake member according to an embodiment of the present invention.
Figure 9:
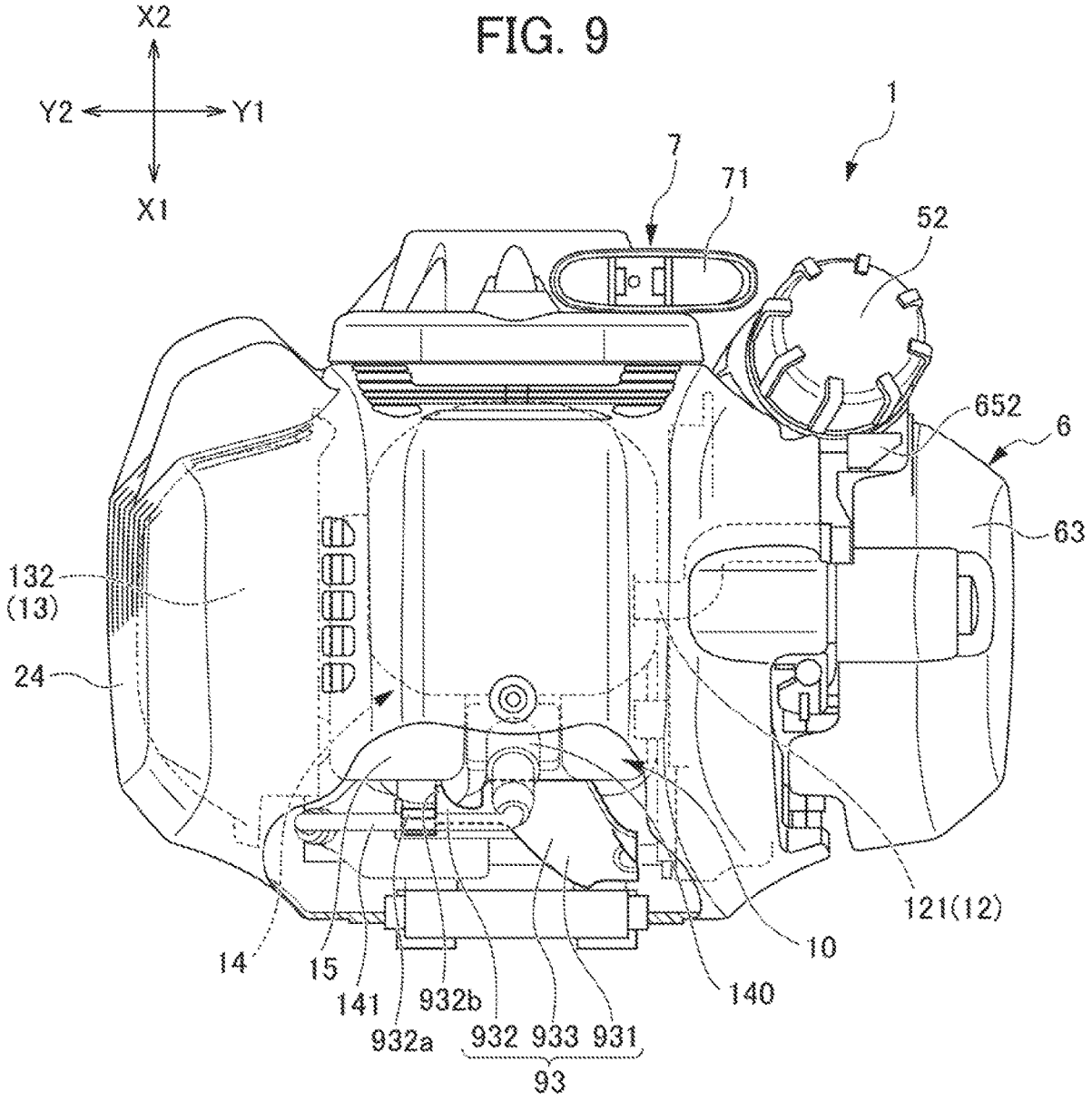
FIG. 9 is a first transverse sectional view of an all-purpose engine having an intake member according to an embodiment of the present invention.
Figure 10:
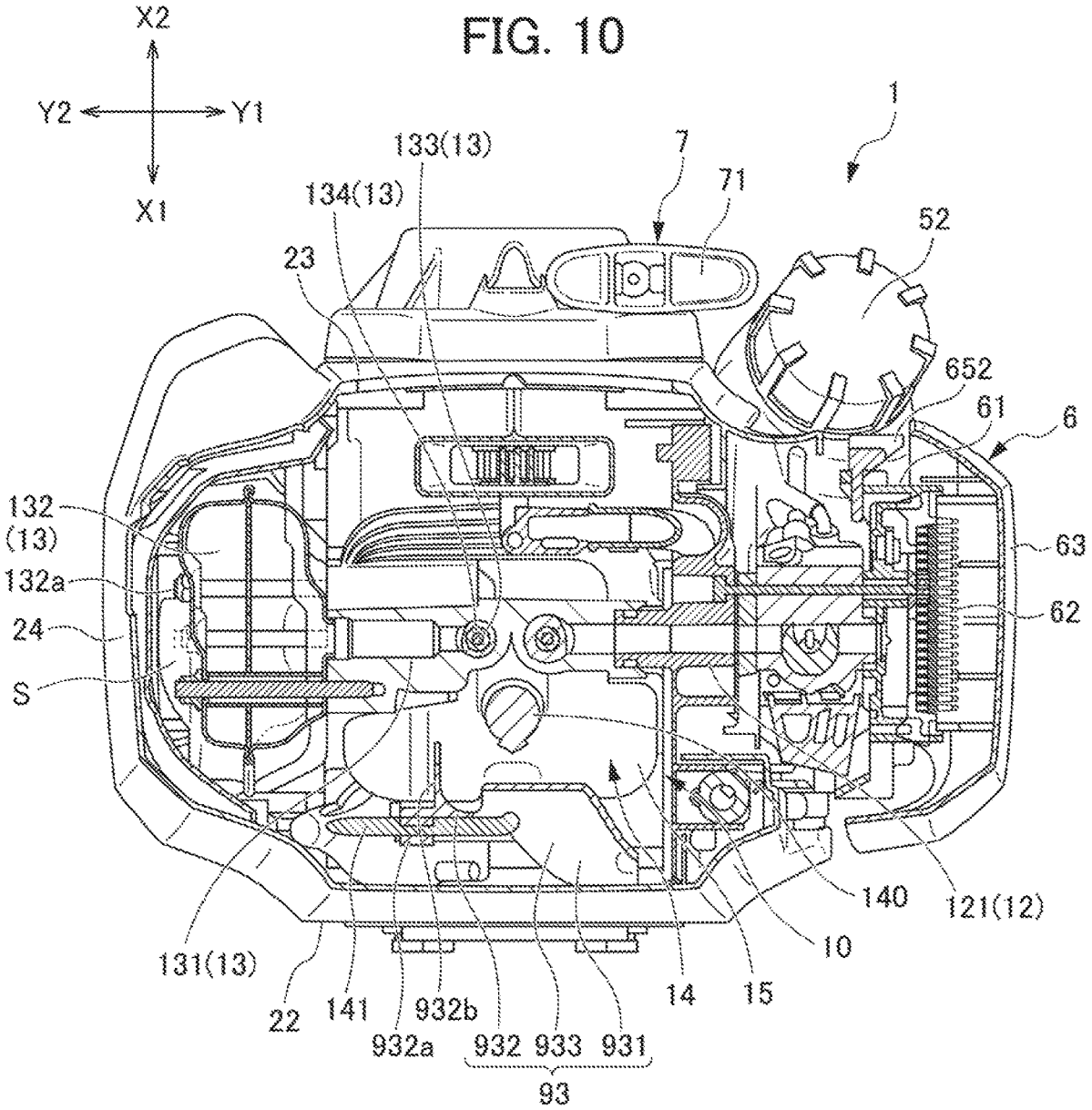
FIG. 10 is a second transverse sectional view of an all-purpose engine having an intake member according to an embodiment of the present invention.

FIG. 1 is a forward perspective view of an all-purpose engine having an intake member according to an embodiment of the present invention; FIG. 2 is a rearward perspective view of an all-purpose engine having an intake member according to an embodiment of the present invention. FIG. 3 is a front view of an all-purpose engine having an intake member according to an embodiment of the present invention. FIG. 4 is a rear view of an all-purpose engine having an intake member according to an embodiment of the present invention. FIG. 5 is a plan view of an all-purpose engine having an intake member according to an embodiment of the present invention. FIG. 6 is a first longitudinal sectional view of an all-purpose engine having an intake member according to an embodiment of the present invention. FIG. 7 is a second longitudinal sectional view of an all-purpose engine having an intake member according to an embodiment of the present invention. FIG. 8 is a third longitudinal sectional view of an all-purpose engine having an intake member according to an embodiment of the present invention. FIG. 9 is a first transverse sectional view of an all-purpose engine having an intake member according to an embodiment of the present invention. FIG. 10 is a second transverse sectional view of an all-purpose engine having an intake member according to an embodiment of the present invention.

Herein, the third longitudinal sectional view of FIG. 8 is a longitudinal sectional view more to the front side 22 side of the top cover 2 than the second longitudinal sectional view of FIG. 7, and the second longitudinal sectional view of FIG. 7 is a longitudinal sectional view more to the front surface 22 side than the first longitudinal sectional view of FIG. 6. In addition, the second transverse sectional view of FIG. 10 is a transverse sectional view below the first transverse sectional view of FIG. 9. FIG. 6 is a partial longitudinal sectional view, and FIG. 9 is a partial transverse sectional view.

It should be noted that the arrows shown in each drawing indicate the direction of the all-purpose engine 1. The arrow X1-X2 indicates the front/rear direction of the all-purpose engine 1. X1 direction is front and X2 direction is rear. The arrow Y1-Y2 indicates the left/right direction of the all-purpose engine 1. The left/right direction of the all-purpose engine 1 is defined as indicating the left/right direction in a state of viewing the all-purpose engine 1 from the front, i.e. state viewing the all-purpose engine 1 in the X2 direction. Therefore, the Y1 direction is right, and the Y2 direction is left. The arrow Z1-Z2 direction indicates the height direction (direction along gravity direction) of the all-purpose engine 1. The Z1 direction is up, and the Z2 direction is down. In addition, all-purpose engine indicates a multi-purpose engine for which the application is not specified, as for an automobile or motorcycle.

In the present embodiment, the all-purpose engine 1 can be used as a drive source of a small-scale work machine such as a weed trimmer, for example. The all-purpose engine 1 is a four-stroke engine of higher horsepower than conventional, irrespective of its small scale. The all-purpose engine 1 can run even if tilted 360 degrees, and is suitable as the drive source of handheld work machines such as a weed trimmer. In the case of being used in a weed trimmer, the all-purpose engine 1 is attached to a base end of a drive shaft to which a blade is attached at the leading end.

The all-purpose engine 1 includes: an engine main body 10; a shroud 4 configured to include a top cover 2, bottom cover 3 and inner cover 25; a fuel tank 5; an air cleaner 6; a recoil starter 7; a tank guard 51; a refilling cap 52; a fuel tube 53; a fuel return tube 54; a centrifugal clutch 8; and a cooling mechanism 9.

The engine main body 10 has: a cylinder block 14; and a crank case 16 which is connected to the cylinder block 14. The cylinder block 14 has a cylinder 11 and cylinder head 15 formed integrally. The cylinder 11 accommodates a piston 110 to be slidable, and the piston 110 is connected to a crank shaft 17. A spark plug 140; intake-system component 12 having an intake port 121; and an exhaust-system component 13 having an exhaust port 131, canister muffler 132, exhaust valve 133, exhaust valve guide 134 supporting the exhaust valve 133, etc. are attached to the cylinder 11. The crank case 16 supports the crank shaft 17.

The top cover 2 is arranged at the upper part of the all-purpose engine 1, and is a cover which covers the upper part of the engine main body 10 (cylinder block 14, crank case 16, etc.). The top cover 2 is a cover of substantially dome shape in which the bottom is open, and is formed so as to cover the cylinder block 14, etc. in which the cylinder 11 and cylinder head 15 are formed integrally. In addition, on one side among both sides of the all-purpose engine 1 (left side in the drawing), the exhaust port 13 and canister muffler 132 are arranged to be accommodated, and the top cover 2 is formed so as to cover these. It should be noted that the canister muffler 132 is arranged between the fuel tank 5 described later and the engine main body 10, and reduces the sound (exhaust sound) generated upon exhaust being emitted to outside and sound (intake sound) generated upon air being drawn into the intake plumbing, as well as preventing transpiration by reducing the pressure and temporarily capturing thermally expanded vaporized fuel.

A plurality of ventilation ports is formed in the top cover 2. In detail, a top ventilation port 2*a*, side ventilation port 2*b* and back ventilation port 2*c* are formed. This top ventilation port 2*a*, side ventilation port 2*b* and back ventilation port 2*c* are used in the release of heat generated from the engine main body 10, particularly the cylinder 11 and exhaust-system component 13. In addition, cooling air from a cooling fan 90 described later is used in the cooling of the engine main body 10, etc., and is then released from this plurality of ventilation ports.

The top ventilation port 2*a* is formed in an outside surface part 203 constituting the outside surface of a bridge part described later, on the left side of the all-purpose engine 1 to which the above-mentioned exhaust system is arranged. The top ventilation port 2*a* is configured by a plurality of notches extending obliquely upwards from an outer side towards the inner side. The side ventilation port 2*b* is formed in a left-side surface 24 of the all-purpose engine 1 to which the above-mentioned exhaust system is arranged. The side ventilation port 2*b* is configured by a plurality of notches extending in the front/rear direction on the back side of the left-side surface 24. The back ventilation port 2*c* is formed along a wide range of the back surface 23 of the top cover 2. The back ventilation port 2*c* is configured by a plurality of notches of different length extending in the left/right direction.

In addition, in the upper surface 21 of the top cover 2, a pair of bridge parts 20, 20 are formed so as to be arranged opposingly. This pair of bridge parts 20, 20 has symmetrical shapes to each other relative to a central part of the upper surface 21 of the top cover 2. The pair of bridge parts 20, 20 is formed so as to project from the upper surface 21 of the top cover 2, and constitutes an apex of the top cover 2. In addition, this pair of bridge parts 20, 20 extends to connect from the front surface 22 of the top cover 2 until the back surface 23 through the upper surface 21. In other words, the front surface 22 and back surface 23 of the top cover 2 are bridged by this pair of bridge parts 20, 20.

The pair of bridge parts 20, 20 respectively has: a surface part 201 constituting the surface thereof; and an inside surface part 202 constituting an inner surface and an outside surface part 203 constituting the outer surface, which link the surface part 201 and the upper surface 21 of the all-purpose engine 1. This pair of bridge parts 20, 20 is arranged opposingly in substantially parallel in a plan view of the all-purpose engine 1 as shown in FIG. 5.

The surface part 201 constituting the surface of each bridge part 20 is continuous with the front surface 22 of the top cover 2 without a step, and is also continuous with the back surface 23 of the top cover 2 without a level step. The surface part 201, in a front view of the all-purpose engine 1, has a tapered shape in which the width narrows moving upwards. Similarly, also in the back view of the all-purpose engine 1, it has a tapered shape in which the width narrows moving upwards. For this reason, in a plan view of the all-purpose engine 1 as shown in FIG. 5, in the pair of bridge parts 20, 20, the width dimension increases towards the front surface 22 side, and similarly, the width dimension increases towards the back surface 23 side. Even in a case of increasing the size due to raising output of the all-purpose engine 1, and the width increasing, as a result of the line of sight being guided to the longitudinal direction by the pair of bridge parts 20, 20, it thereby comes to give a slim impression in the shape as a whole, and seems to be small.

In addition, the surface part 201 constituting the surface of each bridge part 20 slopes downwards as approaching the outside, in a front view of the all-purpose engine 1. In other words, the surface parts 201, 201 of the pair of bridge parts 20, 20 are positioned higher towards the inside and positioned lower towards the outside. In the case of placing the all-purpose engine 1 upside down, since both inside portions of the surface parts 201, 201 of the pair of bridge parts 20, 20 contact the placement surface preferentially, the pair of bridge parts 20, 20 thereby function as supports, and a stable posture is secured. At the same time, the placement surface area decreases without the upper surface 21 of the all-purpose engine 1 directly contacting the placement surface, and the upper surface 21 is prevented from being damaged, and thus protection of the label attached to the upper surface 21 becomes possible.

The inside surface part 202 constituting the inner surface linking the surface of each bridge part 20 and the upper surface 21 of the top cover 2 slopes to the outer side as approaching the surface of the bridge part 20 from the upper surface 21 of the all-purpose engine 1, in a front view of the all-purpose engine 1. In other words, the inside surface parts 202, 202 of the pair of bridge parts 20, 20 are formed so as to separate from each other as approaching towards the surface of each bridge part 20 from the upper surface 21 of the top cover 2. In the case of the all-purpose engine 1 being placed in a state upside down, as a result of the force in the outside direction acting on the pair of bridge parts 20, 20 functioning as supports, a more stable posture is thereby secured.

The outside surface part 203 constituting the outside surface linking the surface of each bridge part 20 and the upper surface 21 of the top cover 2 slopes downwards towards the outside. A much sharper and slimmer external shape thereby comes to be obtained.

The bottom cover 3 is arranged at the lower part of the all-purpose engine 1, and is a cover which covers the lower part of the engine main body 10. The bottom cover 3 is a cover of substantially semicircular shape in the front view of the all-purpose engine 1, and is formed so as to cover the cooling fins 91 provided to a flywheel 910 which is connected to rotate with the crankshaft 17, the crank case 16 which is connected to the above-mentioned cylinder block 14, etc. It should be noted that the flywheel 910 makes it possible to achieve smooth low speed rotation of the all-purpose engine 1 having a small number of cylinders using the inertia during rotation. In the present embodiment, a plurality of cooling fins 91 is formed at the circumferential edge of this flywheel 91, and the cooling fan 90 is thereby configured.

In the front surface side of the bottom cover 3, a connection hole 30 to which the drive shaft of the weed trimmer (not illustrated) is connected is formed. Inside this connection hole 30, the centrifugal clutch 8 which engages or disengages the drive shaft by only an increase/decrease in rotation speed of the crank shaft 17 is arranged, and the drive shaft is engaged to the crankshaft 17 via this centrifugal clutch 8. It should be noted that, with the centrifugal clutch 8, the torque is transmitted by the clutch shoe 81 rotating together with the crankshaft 17 being pressed against the clutch drum on the drive shaft by way of centrifugal force, and the torque transmission is disengaged by the clutch shoe 8 being distanced from the clutch drum by way of the resilience of a spring 82 as the rotation speed of the crankshaft 17 declines and centrifugal force weakens.

As explained above, the shroud 4 configured to include the top cover 2, bottom cover 3 and inner cover 25 is formed so as to cover the engine main body 10 which is configured to include the cylinder block 14 in which the cylinder 11 and cylinder head 15 are formed integrally, and the crank case 16 which is coupled to this cylinder block 14. The shroud 4 is configured from a resin member, and is fixed by bolts to the engine main body 10. The shape of this shroud 4, particularly the shapes of the top cover 2 and bottom cover 3, mainly constitutes the external shape of the all-purpose engine 1.

The fuel tank 5 is arranged at a lower part of the all-purpose engine 1. The fuel tank 5 constitutes the overall lower part of the all-purpose engine 1, and extends substantially in an arc shape in a front view of the all-purpose engine 1. Laterally on the intake side to which the air cleaner 6 is arranged, among both sides of the all-purpose engine 1 (right side of all-purpose engine 1 in drawing), a refilling cap 52 which blocks the fuel filling opening, a fuel tube 53 which supplies fuel to the engine main body, and a fuel return tube 54 which circulates fuel to the fuel tank 5 are arranged at the fuel tank 5.

A tank guard 51 which is a plate-shaped protective member covering the back surface side of the fuel tank 5, and extending in the up/down direction at the central portion in the left/right direction of the all-purpose engine 1 is arranged at the back surface side of the fuel tank 5. In this tank guard 51, mounting holes 51*a* for mounting the recoil starter 7 are formed. It should be noted that the recoil starter 7 is configured to include a pulley (not illustrated) in addition to a grip 71, a rope which is wound around the pulley and connected to the grip 71, etc., and causes the all-purpose engine 1 to start by giving rotational force to the crank shaft 17 by the manipulation of the grip 71 by the user.

The air cleaner 6 is arranged at a side of the intake side among both sides of the all-purpose engine 1 (right side of all-purpose engine 1 in the drawing). The air cleaner 6 is connected to an upstream side along the flow direction of intake air to the carburetor 60, and purifies the intake air to the carburetor 60. This air cleaner 6 will be described in detail at a later stage.

The cooling mechanism 9 supplies cooling air for cooling the engine main body 10. The cooling mechanism 9 has the cooling fan 90, nozzle part 92, and air guide 93.

The cooling fan 90 is configured by a plurality of cooling fins 91 being formed at the periphery of the flywheel 910 as mentioned above. This cooling fan 90 rotates by the flywheel coaxially arranged with the crankshaft 17 integrally rotating by way of rotation of this crankshaft 17, thereby generating cooling air.

The nozzle part 92 blows the cooling air generated by rotation of the cooling fan 90 into the all-purpose engine 1. The nozzle part 92 is arranged at the side of the intake side of the cooling fan 90 (right side in the drawing). The nozzle part 92 becomes a channel through which the cooling air flows, and a convex part 921 which directs the cooling air towards the air guide 93 is formed by projecting to the inner side at the inside of the nozzle part 92. In more detail, the convex part 92 is formed to project towards the inner side at the outer circumferential part of the channel outlet constituting the nozzle part 92. By way of this convex part 921, the cooling air blowing from the nozzle part 92 is more reliably guided towards the cylinder 11 and exhaust-system component 13, whereby the cylinder 11 and exhaust-system component 13 can be more efficiently cooled.

The air guide 93 guides the cooling air blown from the nozzle part 92 towards the cylinder 11 and exhaust-system component 13 (exhaust port 131, canister muffler 132, exhaust valve 133, exhaust valve guide 134, etc.; same below).

The air guide 93 is arranged above the cooling fan 90. In addition, the air guide 93 has: an air guide main body 931 of substantially L-shaped cross section which extends towards the nozzle part 92 in a state in which a bend 933 faces the side of the exhaust-system component 13; and a fixing part 932 which fixes the air guide main body 931 to the side of the engine main body 10.

By way of this air guide 93, the cooling air produced from the rotation of the cooling fan 90 is efficiently guided towards the cylinder 11 and exhaust-system component 13 from the nozzle part 92. For this reason, the cylinder 11 and exhaust-system component 13 which tend to become high temperature accompanying the raising of output of the all-purpose engine 1 becomes able to efficiently cool.

In more detail, the air guide main body 931 obliquely extends towards the side of the engine main body 10 from the side of the front surface 22 of the all-purpose engine 1, as approaching the side of the exhaust-system component 13 from the side of the nozzle part 92. The cooling air blown from the nozzle part 92 thereby comes to be guided more reliably to the engine main body 10 and exhaust-system component 13.

In addition, the fixing part 932 has: a fitting part 932*a* which is fitted by a high-tension cord connected to the spark plug 14 being inserted; and an engaging part 932*b* which projects towards the side of the cylinder block 14 and engages with the gap of the cylinder block 14. The air guide main body 831 is fixed to the engine main body 10 by this fitting part 932*a* and engaging part 932*b*.

Next, cooling to a stud bolt 132*a*, which is a fixture of the canister muffler 132 of the all-purpose engine 1 according to the present embodiment, will be explained in detail by referencing FIG. 8, etc.

As shown in FIG. 8, a space S through which the cooling air blown towards the upper part of the engine main body 10 from the nozzle part 92 can flow from above to below is formed between the shroud 4 and canister muffler 132. This space S is formed by the left-side surface 24 on the side of the exhaust-system component 13 of the top cover 2 constituting the shroud 4 swelling to the outer side. The space S is formed from the upper part to the lower part of the canister muffler 132, and a clearance between the canister muffler 132 is secured to be larger moving downwards. By this space S, the cooling air from the upper part of the engine main body 10 (cylinder block 14, etc.) is flowed to the circumference of the canister muffler 132, whereby the canister muffler 132 is cooled.

In addition, a return part 40 guiding the cooling air towards the stud bolt 132*a* fixing the canister muffler 132 to the engine main body 10 is formed at the inner wall surface of the shroud 4 (left-side surface 24 on the exhaust-system component 13 side of the top cover 2) forming the space S. The return part 40 is arranged between the top cover 2 and the bottom cover 3, and is formed in the inner cover 25 constituting the shroud 4. In more detail, the return part 40 is formed by the inner wall surface of the inner cover 25 projecting to the inner side, towards the stud bolt 132*a* arranged at the lower part of the canister muffler 132. In the longitudinal sectional view shown in FIG. 8, the return part 40 has a sloped surface which slopes downwards more as moving to the inner side. The cooling air which can flow in from above is guided towards the stud bolt 132*a* by this sloped surface.

It should be noted that the stud bolt 132*a* to which the cooling air is guided by the above-mentioned return part 40 is arranged at the lower part of the canister muffler 132. Other than the stud bolt 132*a* arranged at the lower part, although the fixture of the canister muffler 132 is also arranged at the upper part and center part of the canister muffler (refer to FIGS. 8 and 10), it is effective to guide cooling air to the stud bolt 132*a* arranged at the lower part of the canister muffler 132 which tends to keep the most heat and tends to become high temperature. As shown in FIG. 8, the leading end of the stud bolt 132*a* is fixed by being inserted into a boss 16*a*, which is a mounting part of the crank case 16 constituting the engine main body 10.

Figure 11:
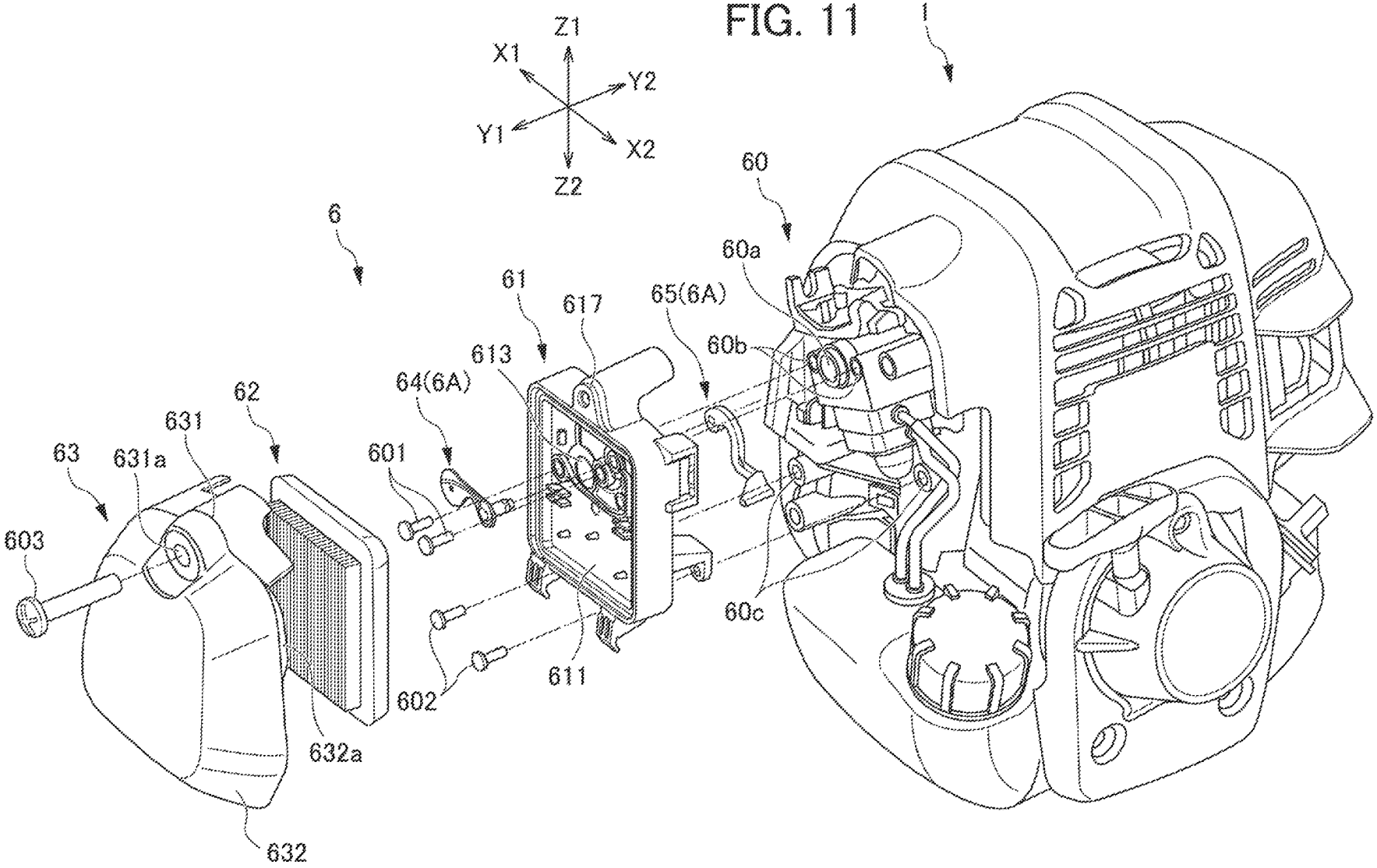
FIG. 11 is a perspective view showing part of the all-purpose engine having an intake member according to an embodiment of the present invention to be disassembled.
Figure 12:
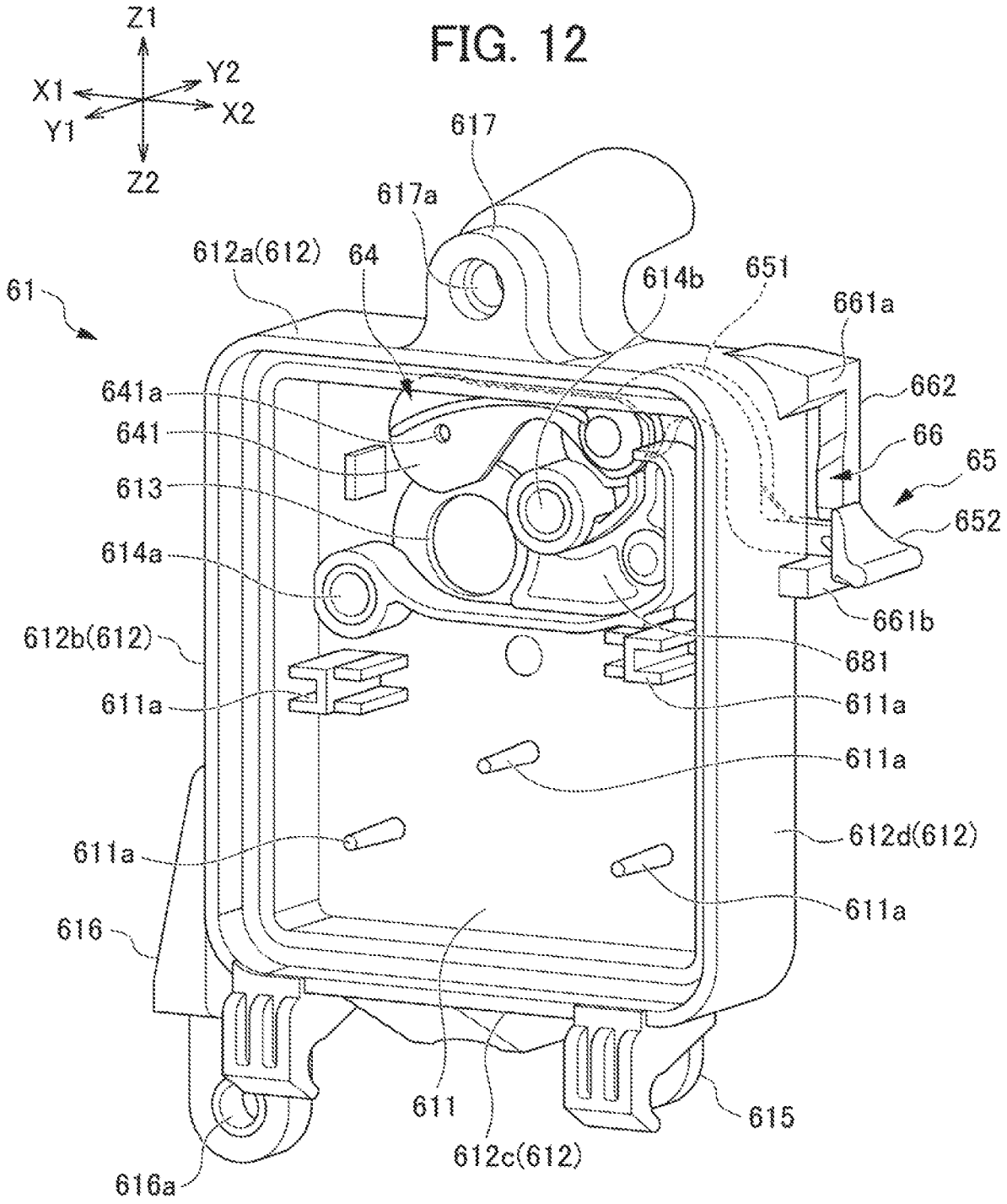
FIG. 12 is a perspective view looking at an intake member according to an embodiment of the present invention from outside.
Figure 13:
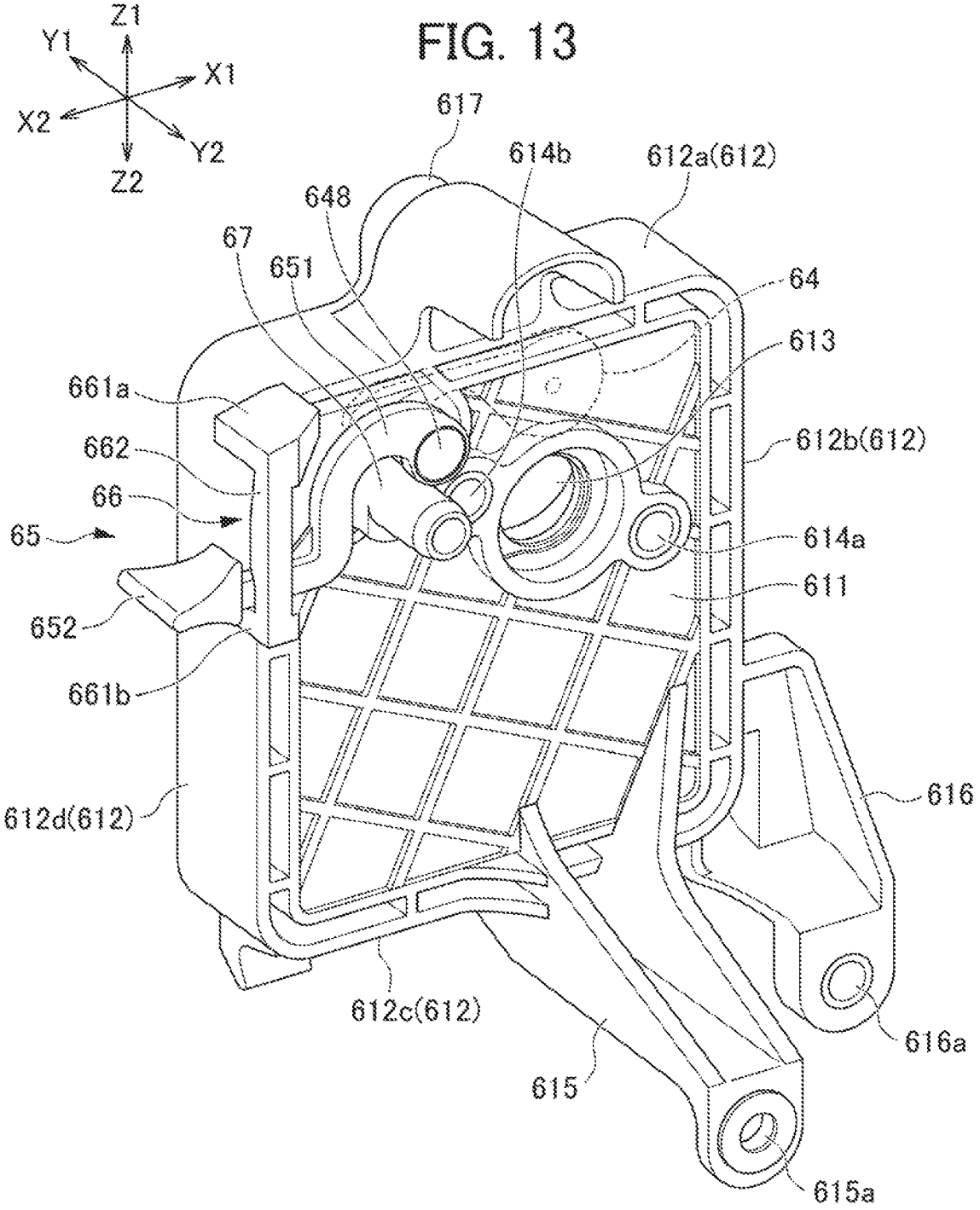
FIG. 13 is a perspective view looking at an intake member according to an embodiment of the present invention from inside.
Figure 14:
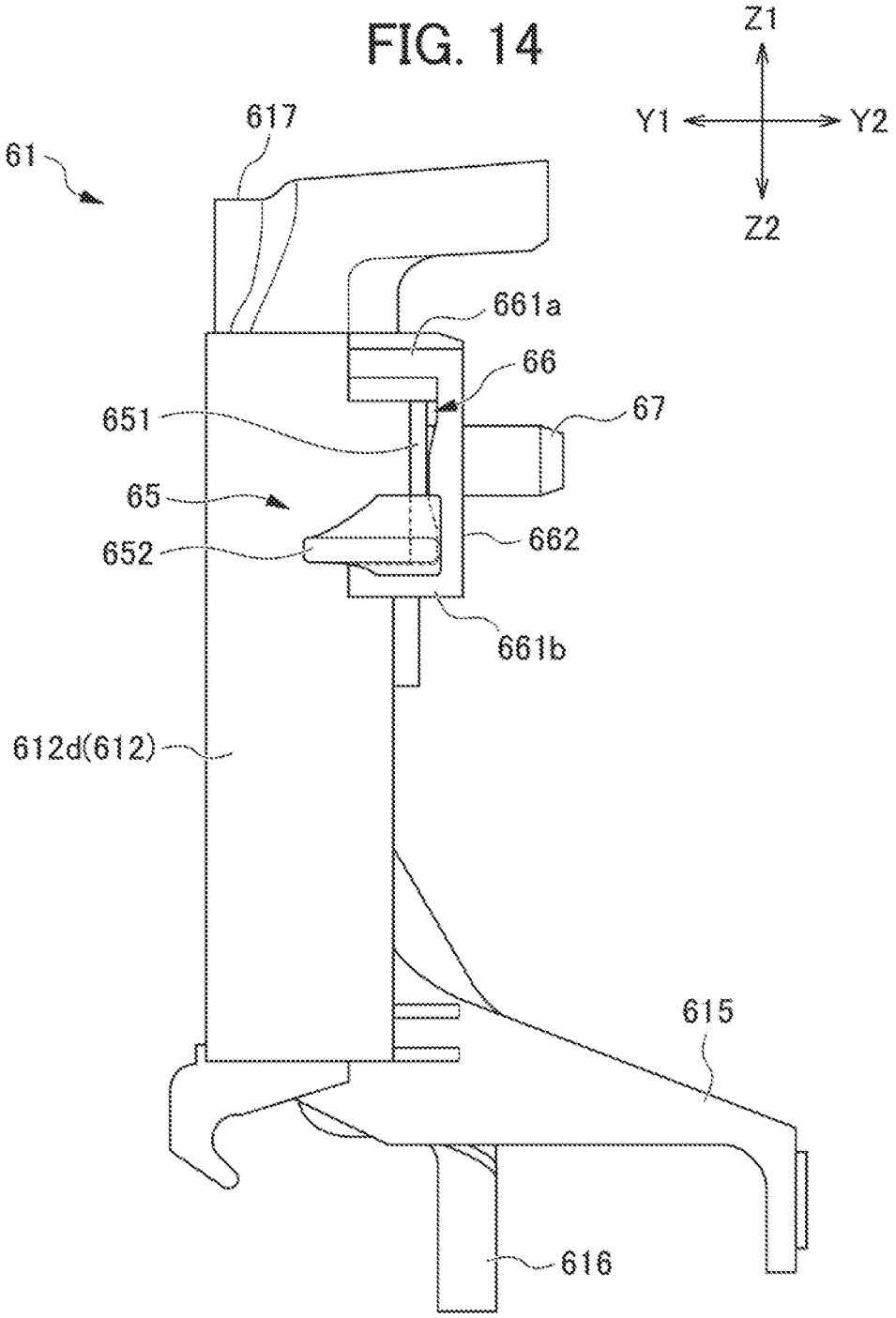
FIG. 14 is a rear view of an intake member according to an embodiment of the present invention.
Figure 15:
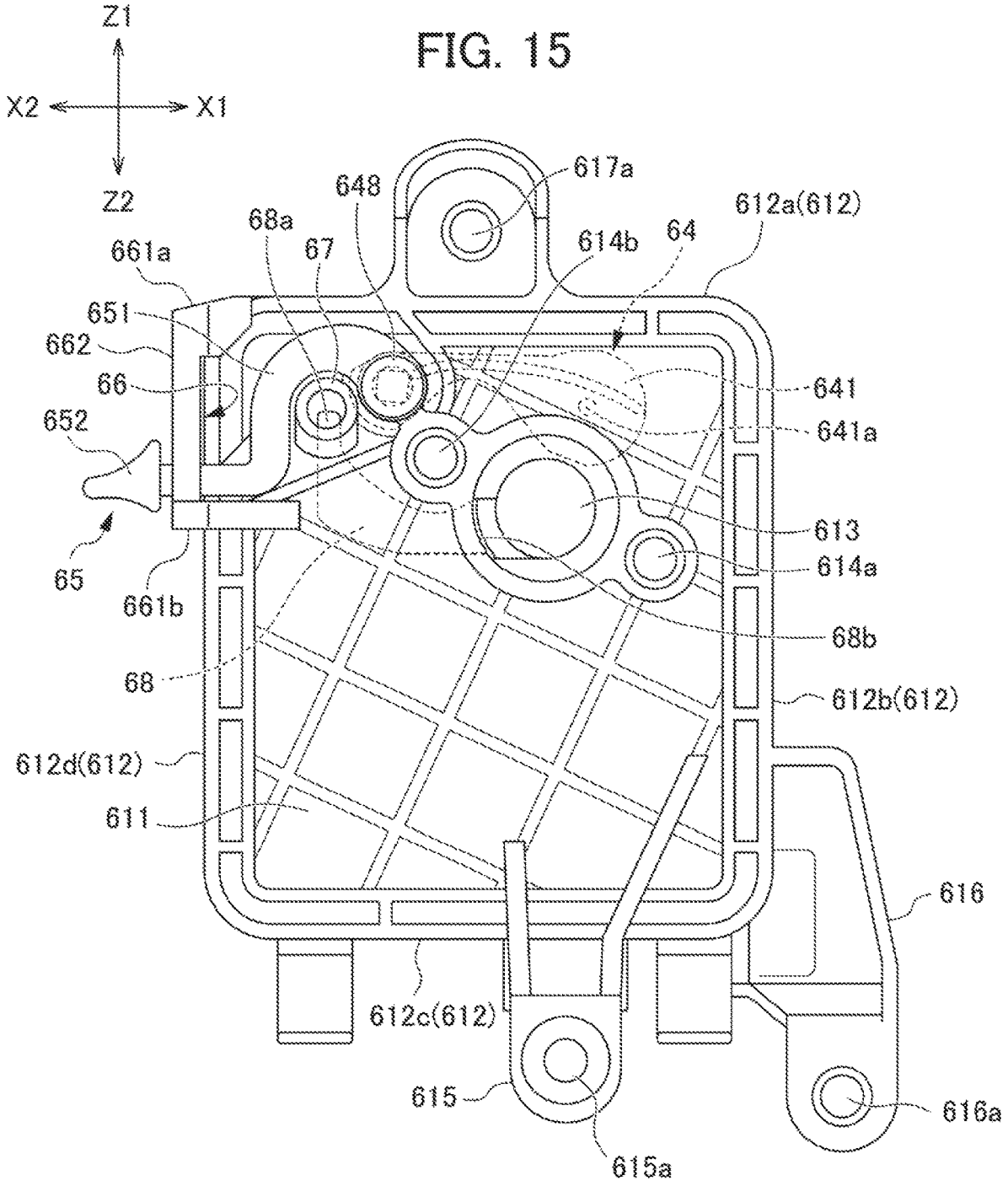
FIG. 15 is a side view looking at an intake member according to an embodiment of the present invention from inside.

Next, the air cleaner 6 provided to the all-purpose engine 1 according to the present embodiment will be explained. FIG. 11 is a perspective view showing part of the all-purpose engine having the intake member according to an embodiment of the present invention to be disassembled. FIG. 12 is a perspective view looking at the intake member according to an embodiment of the present invention from an outer side. FIG. 13 is a perspective view looking at the intake member according to an embodiment of the present invention from an inner side. FIG. 14 is a back view of the intake member according to an embodiment of the present invention. FIG. 15 is a side view looking at the intake member according to an embodiment of the present invention from an inner side. The air cleaner 6 provided to the air-purpose engine 1 according to the present embodiment is arranged to an outer side of the carburetor 60, more specifically, the opposite side (Y1 direction side) to the engine main body 10 interposing the carburetor 60. As shown in FIG. 11, the air cleaner 6 has an air cleaner case 61, air filter 62, cover 63, choke valve 64 and choke lever 65. The choke valve 64 and choke lever 65 constitute an opening/closing mechanism 6A which opens/closes the opening 613 of the air cleaner case 61, by being provided to the air cleaner case 61.

The air cleaner case 61 shown in the present embodiment is an embodiment of an intake member. The air cleaner case 61 is a box-type container made of resin consisting of polypropylene, for example, and has an end wall 611 formed in a slightly elongated rectangular shape; and a side wall 612 provided so as to surround the square periphery of this end wall 611. The end wall 611 is arranged so as to face the left/right direction (Y1-Y2 direction) of the all-purpose engine 1. The side wall 612 is provided to as to project a predetermined height towards the opposite side (Y1 direction side) to the carburetor 60 from the square periphery of the end wall 611.

At a position somewhat more forward (X1 direction) and somewhat above (Z1 direction) the central part of the end wall 611, one circular opening 613 for sending intake air through the intake opening 60*a* provided to the carburetor 60 to this carburetor 60*a* is provided.

In addition, the end wall 611 has two sleeve-shaped through holes 614*a*, 614*b* at positions interposing the opening 613. In the through holes 614*a*, 614*b*, fixtures 601, 601 such as two bolts for attaching the air cleaner case 61 to the carburetor 60 are inserted. Among the two through holes 614*a*, 614*b*, the through hole 614*a* arranged more to the forward side (X1 direction side) than the opening 613 is arranged slightly below in the height direction than the center of the opening 613. In addition, the through hole 614*b* arranged more to the rear side (X2 direction) than the opening 613 is arranged slightly above in the height direction than the center of the opening 613. The two fixtures 601, 601 come to respectively penetrate these through holes 614*a*, 614*b* and thread into the corresponding mounting holes 60*b*, 60*b* on the side of the carburetor 60.

In addition, the side wall 612 has a first mounting leg 615 and second mounting leg 616 projecting to the side of the carburetor 60. The first mounting leg 615 is arranged at the lower end 612*c* arranged lower among the side wall 612, and extends to greatly project from the lower wall 612*c* to the side of the carburetor 60. The second mounting leg 616 is provided so as to overhang further forwards and downwards from the lower part of the front side wall 612*b* which is arranged forwards, among the side walls 612. A through hole 615*a* is provided at the leading end of the first mounting leg 615. In addition, the through hole 616*a* is provided to a lower end of the second mounting leg 616. In these through holes 615*a*, 616*a*, the fixtures 602, 602 such as nuts and bolts respectively penetrate, and come to thread into the corresponding mounting holes 60*c*, 60*c* on the side of the engine main body 10, respectively.

The air cleaner case 61 is mounted to the carburetor 60 and engine main body 10 by the fixtures 601, 601, 602, 602 in this way. At this time, the opening 613 communicates with the intake opening 60*a* of the carburetor 60.

The air filter 62 shown in the present embodiment is an embodiment of a filter part. The air filter 62 is a filter member of a square shape substantially equal to the internal shape surrounded by the side walls 612 of the air cleaner case 61, and is accommodated so as to fit inside of the side walls 612 of the air cleaner case 61. The intake air (air) purified by passing through the air filter 62 comes to be sent to the intake opening 60*a* of the carburetor 60 through the opening 613. A plurality of support protrusions 611*a* for supporting the air filter 62 accommodated inside of the side wall 612 with a predetermined separating distance from the end wall 611 is provided to project at a surface of the end wall 611 on the side of the air filter 62.

The cover 63 shown in the present embodiment is an embodiment of a covering part. The cover 63 is arranged at the outer most side of the air cleaner 6, and conceals the outer side of the air cleaner case 61 accommodating the air filter 62. At the upper part of the cover 63, it has an upper covering part 631 extending so as to cover the upper part of the air cleaner case 61. The upper covering part 631 is arranged so as to cover above the cover mounting part 617 provided to an upper side wall 612*a* arranged above among the side walls 612 of the air cleaner case 61. In addition, in order to prevent malfunction by stress accidentally acting from outside on the choke lever 65 constituting the opening/closing mechanism 6*a* of the present embodiment, the cover 63 has a flange part 632*a* formed to project from the cover main body 632 and covering from an outer side the holding part 652 of the choke lever 65.

It should be noted that the cover mounting part 617 extends in the same direction (Y2 direction) as the upper covering part 631 of the cover 63, and is arranged so as to cover above the carburetor 60 together with the upper covering part 631. The cover mounting part 617 has a through hole 617*a* in which female threads are formed. The cover 63 is mounted to the air cleaner case 61, by the fixture 603 such as a bolt threading together with the penetrating hole 617*a* through the through hole 631*a* provided in the upper covering part 631 of the cover 63.

Figure 16:
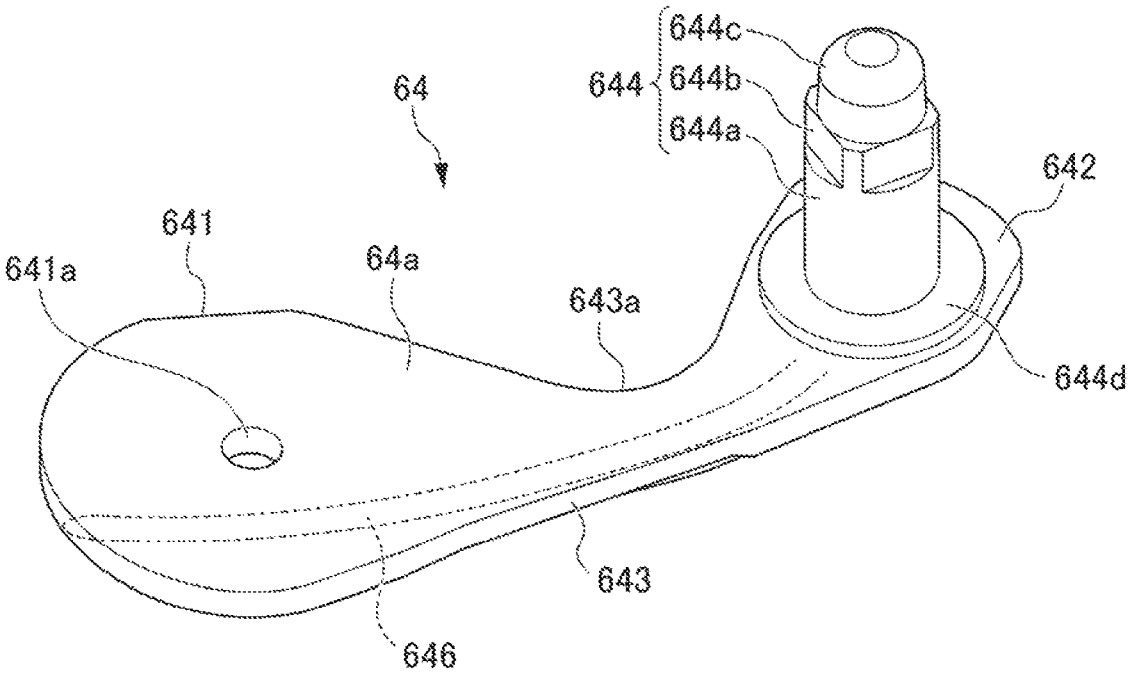
FIG. 16 is a perspective view looking at an opening/closing member according to an embodiment of the present invention from a connecting side with the working member.
Figure 17:
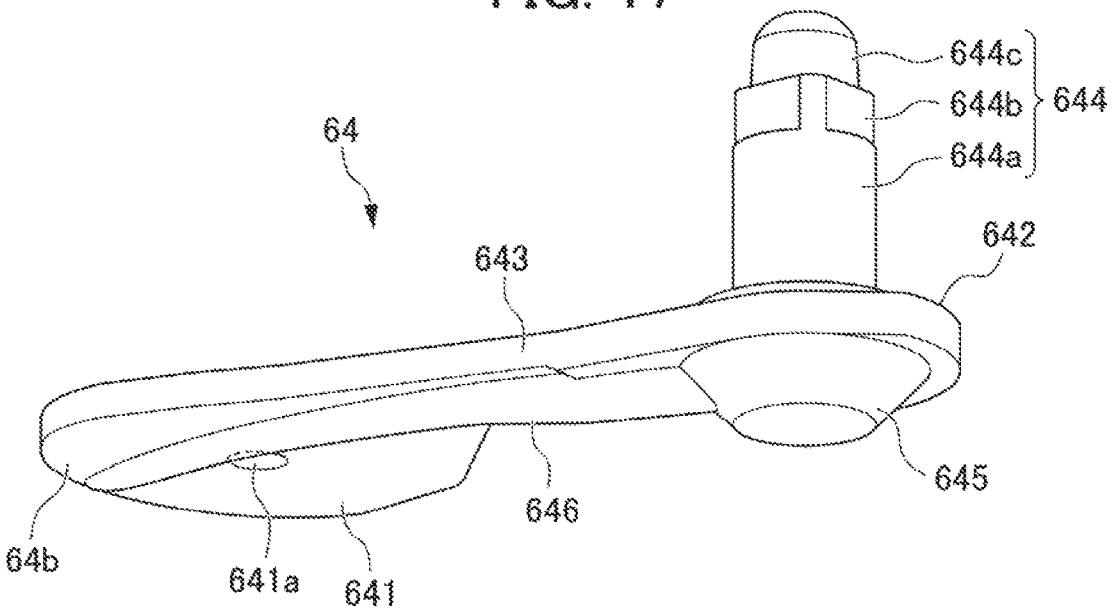
FIG. 17 is a perspective view looking at an opening/closing member according to an embodiment of the present invention from an opposite side to the connecting side with the working member.
Figure 18:
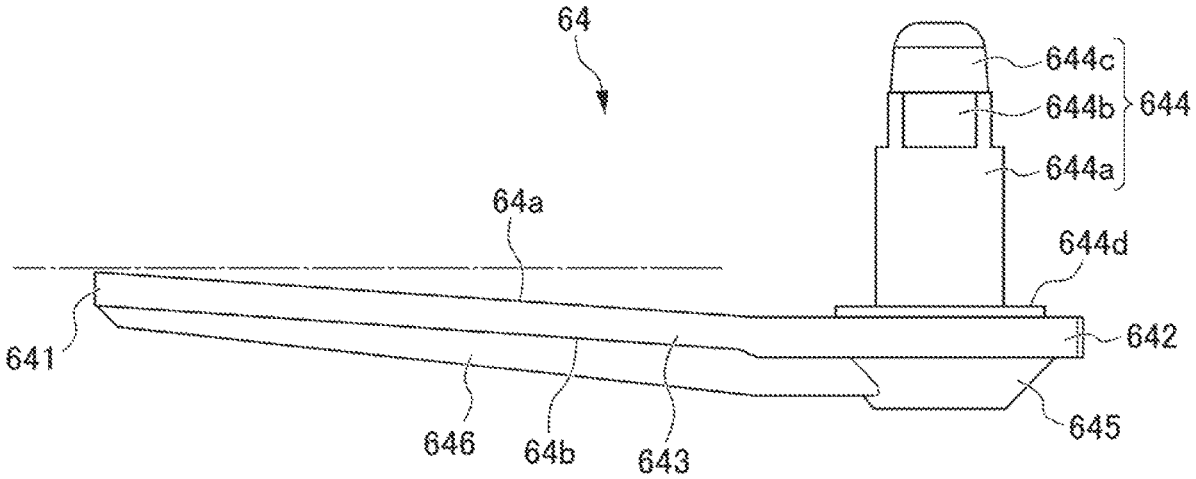
FIG. 18 is a plan view of an opening/closing member according to an embodiment of the present invention.
Figure 19:
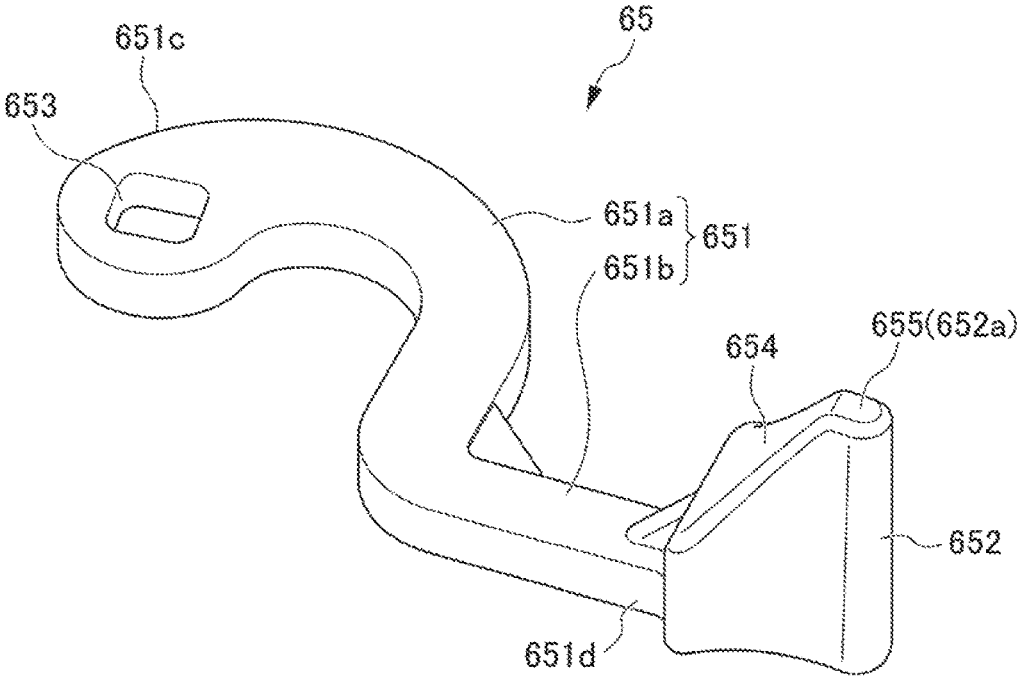
FIG. 19 is a perspective view looking at a working member according to an embodiment of the present invention from a connecting side with the opening/closing member.
Figure 20:
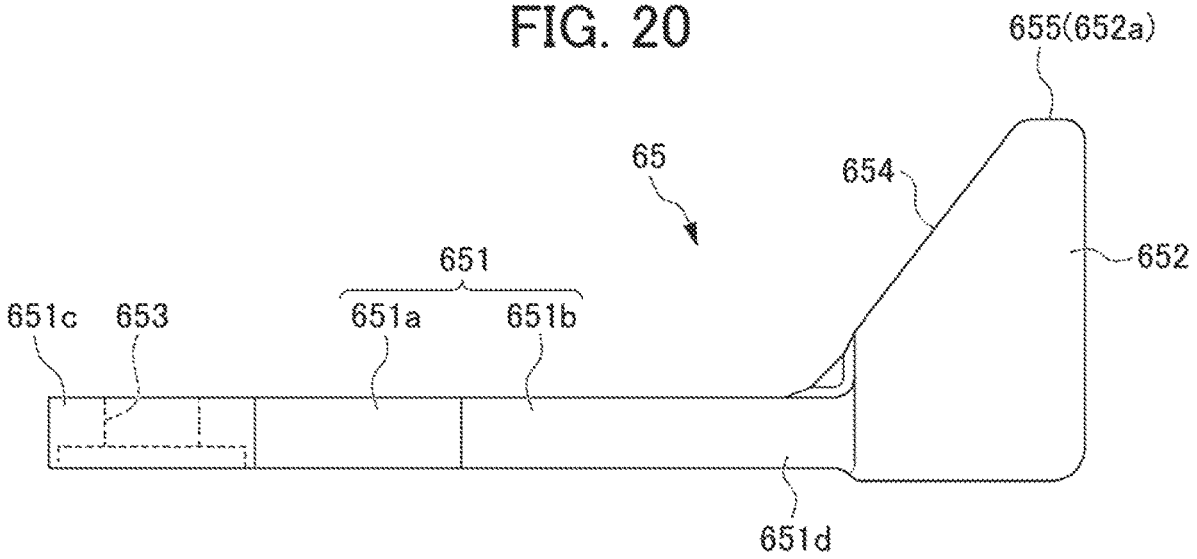
FIG. 20 is a bottom view of a working member according to an embodiment of the present invention.

Next, the opening/closing mechanism 6A will be further explained by referencing FIGS. 16 to 20. FIG. 16 is a perspective view looking at the opening/closing member according to an embodiment of the present invention from a connecting side with the working member. FIG. 17 is a perspective view looking at the opening/closing member according to an embodiment of the present invention from the opposite side to the connecting side with the working member. FIG. 18 is a plan view of the opening/closing member according to an embodiment of the present invention. FIG. 19 is a perspective view looking at the working member according to the embodiment of the present invention from the connecting side with the opening/closing member. FIG. 20 is a bottom view of the working member according to the embodiment of the present invention. The opening/closing member 6A is mounted to the air cleaner case 61. The opening/closing member 6A of the present embodiment adjusts the intake amount sent to the intake opening 60*a* of the carburetor 60 via the opening 613 by opening/closing the opening 613 of the air cleaner case 61, by being manipulated by an operator handling the all-purpose engine 1.

In the present embodiment, the opening/closing mechanism 6A has: the choke valve 64 arranged at a surface (outer side surface) on the air filter 62 side of the end wall 611 of the air cleaner case 61; and the choke lever 65 arranged on a surface (inner side surface) on the carburetor 60 side of the end wall 611 of the air cleaner case 61. The choke valve 64 is an embodiment of an opening/closing member, and the choke lever 65 is an embodiment of a working member.

The choke valve 64 is arranged between the air filter 62 and the end wall 611. The choke valve 64 is a sheet member made of resin consisting of polyacetal, for example, and has: a substantially circular valve body plate 641 having a size of an extent which can conceal the opening 613 of the air cleaner case 61; a linking plate 642 which is formed in a somewhat smaller diameter than the valve body plate 641, and is linked to the choke lever 65; and a connecting plate 643 of narrow shape which integrally connects the valve body plate 641 and linking plate 642. A small-diameter hole 641*a* is provided in a central part of the valve body plate 641. The small-diameter hole 641*a* is configured so as to be able to communicate the air filter 62 side and the intake opening 60*a* of the carburetor 60, even if the valve body plate 641 completely closes the opening 613, and send a slight amount of intake air to the side of the carburetor 60.

On one surface of the linking plate 642, an engaging shaft 644 serving as a rotation shaft during opening/closing operation of the choke valve 64 is provided to project to engage with the choke lever 65. The engaging shaft 644 has: a first columnar part 644*a* rising vertically from the linking plate 642; a square columnar part 644*b* arranged to link to the leading end of this first columnar part 644*a*; and a second columnar part 644*c* which is arranged to link to a leading end of this square columnar part 644*b*. The square columnar part 644*b* of the present embodiment is a square column, and the largest diameter (length of diagonal line) of this square columnar part 644*b* is substantially equal to the outside diameter of the first columnar part 644*a*. In addition, the outside diameter of the second columnar part 644*c* is somewhat small compared to the outside diameter of the first columnar part 644*a*, and is substantially equal to the distance between the opposing sides of the square columnar part 644*b*. It should be noted that a circular pedestal part 644*d* of larger diameter than the first columnar part 644*a* is provided to the base part of the engaging shaft 644. This pedestal part 644*d* mainly functions as a seat part of an O-ring 647 explained at a later stage.

In the linking plate 642, a reinforcement part 645 of frusto-conical shape is provided to a surface on the opposite side to the engaging shaft 644. This reinforcement part 645 is configured so that the operating force (rotating force) from the choke lever 65 is efficiently transmitted via the engaging shaft 644, by reinforcing the linking plate 642 of the choke valve 64 in a thick shape.

In addition, on a surface 64*b* on the opposite side to the projecting side of the engaging shaft 644 of the choke valve 64, a linear reinforcement rib 646 spanning from the reinforcement part 645 to the valve body plate 641 is provided. The reinforcement rib 646 suppresses the occurrence of excessive warping of the choke valve 64.

As shown in FIG. 18, the choke valve 64 is provided so as to gently slope in the same direction as the projecting direction of the engaging shaft 644, as approaching the valve body plate 641 from the linking plate 642. The surface 64*a* of on the sloping direction side (projecting side of the engaging shaft 644) of the choke valve 64 is a surface mounted along the end wall 611 of the air cleaner case 61; therefore, upon the choke valve 64 being mounted along the end wall 611 of the air cleaner case 61, the side of the valve body plate 641 elastically closes tightly to the end wall 611. Rattling on the side of the valve body plate 641 is thereby suppressed, and upon closing the opening 613 by the valve body plate 641, the circumference of the opening 613 comes to be favorably sealed.

The choke lever 65 is arranged at the surface on the opposite side to the choke valve 64 to interpose the opening 613 of the end wall 611. The choke lever 65 is a sheet member made of resin consisting of polyacetal, for example, and has: an arm part 651 connected with the choke valve 64; and a holding part 652 serving as a part held by the hand (finger) of the operator and manipulated, as shown in FIGS. 19 and 20.

The arm part 651 has: a bend section 651*a* which is bent in a substantially semicircular arc shape; and a linear section 651*b* which extends in an orthogonal direction from one end of the bend section 651*a*. A square hole-shaped engaging hole 653 is provided in one end section 651*c* of the arm part 651 (end on opposite side to the linear section 651*b* of the bend section 651*a*). The choke lever 65 is integrally linked by engagement of this engaging hole 653 and square columnar part 644*b* of the engaging shaft 644 of the choke valve 64. Since the square columnar part 644*b* of the choke valve 64 of the present embodiment is established as a square column, the engaging hole 653 of the choke lever 65 is established as a square hole corresponding to the square column.

It should be noted that the engaging structure between the engaging shaft 644 of the choke valve 64 and the engaging hole 653 of the choke lever 65 may be engagement of the column and circular hole; however, in the case of the square columnar part 644*b* of the engaging shaft 644 of the choke valve 64 and the engaging hole 653 of the choke lever 65 engaging as in the present embodiment, it is preferable due to being able to efficiently transmit the rotational force around the axis of the engaging shaft 644 by the choke lever 65 being operated without loss to the choke valve 64. However, the square columnar part 644*b* and engaging hole 653 are not limited to the square column and square hole of the present embodiment.

The holding part 652 is integrally provided to the other end section 651*d* of the arm part 651. The holding part 652 is provided to be wider than the arm part 651, and extends so as to project in one direction from the other end section 651*d* of the arm part 651. One direction in which this holding part 652 projects is a direction intersecting the movement direction of the arm part 651 with the engaging hole 653 as the center of rotation. In detail, as shown in FIGS. 12 to 14, the holding part 652 extends towards the opposite side to the carburetor 60 (cover 63 side; Y1 direction side) along a rear side end 612*d* arranged on the rearward side 612*d* of the air cleaner case 61, in a state in which the choke lever 65 is mounted to the air cleaner case 61.

The holding part 652 has a width of an extent which can be held by the hand (finger) of the operator by configuring so as to pinch from top/bottom. Although the specific width is not limited, it has a maximum width of about 15 mm in the present embodiment. Herein, at a surface of the air cleaner case 61 opposing the rear side wall 612*d*, the holding part 652 has a notch part 654 which is obliquely notched out, so as to gradually become a narrow shape as moving to a linking part with the arm part 651 (linear section 651*b*), i.e. so as to separate from the rear side wall 612*d*, as shown in FIGS. 19 and 20. In addition, the holding part 652 of the present embodiment has a planar part 655 which links to the notch part 654, at a side end 652*a* opposing the cover 63. By this planar part 655 being provided to the holding part 652, the end in the width direction of the holding part 652, even if having the notch part 654 which is obliquely notched out, will not become a shape in which the leading end is sharp.

It should be noted that, with the holding part 652, when looking from the direction in which the planar part 655 is arranged, an operator can easily pinch by hand (finger), by being provided in a gradually wider shape (thick shape) as moving to the linking part with the arm part 651. Furthermore, the part of this wider shape (thick shape) is provided to bend, as shown in FIGS. 12, 13, 15 and 19. For this reason, the holding part 652 can be more easily pinched by emulating the shape of the hand (finger) of the operator.

The choke lever 65 is inserted into a guide hole 66 provided in the air cleaner case 61. The guide hole 66 is a hole into which the arm part 651 of the choke lever 65 is inserted, and linearly and smoothly guides the movement of this arm part 651 during manipulation of the choke lever 65, and is provided at the upper part of the rear side wall 612*d* among the side walls 612 so as to open in the front/rear direction (X1-X2 direction) of the air cleaner case 61. In more detail, the guide hole 66 is formed in a rectangular shape which is long and narrow in the vertical direction, by the internal space surrounded by upper and lower two movement-direction restricting parts 661*a*, 661*b* and one crossover frame part 662.

The movement direction restricting parts 661*a*, 661*b* are provided to project towards the rearward side (X2 direction side) further from the rear side wall 612*d* of the air cleaner case 61 and opposite side (carburetor 60 side, Y2 direction side) to the air filter 62, and restrict the vertical movement range of the arm part 651 during manipulation of the choke lever 65. The crossover frame part 662 is provided to span the leading ends of the two movement direction restricting parts 661*a*, 661*b*, and guides the movement direction of the arm part 651 during manipulation of the choke lever 65. The crossover frame part 662 is arranged to be shifted to the rearward side (X2 direction side) relative to the rear side wall 612*d* of the air cleaner case 61, and extends along the rear side wall 612*d*, as shown in FIG. 15. The movement direction restricting parts 661*a*, 661*b* and crossover frame 662 are integrally molded with the air cleaner case 61, from the same resin as the air cleaner case 61.

The arm part 651 of the choke lever 65 is arranged so as to run along the end wall 611 through this guide hole 66. On the other hand, the holding part 652 is arranged to project more laterally (X2 direction) of the rear side wall 612*d* than this guide hole 66. At this time, the notch section 654 and planar section 655 of the holding part 652 are arranged so as to face an opposite side to the carburetor 60 (cover 63 side).

Figure 21:
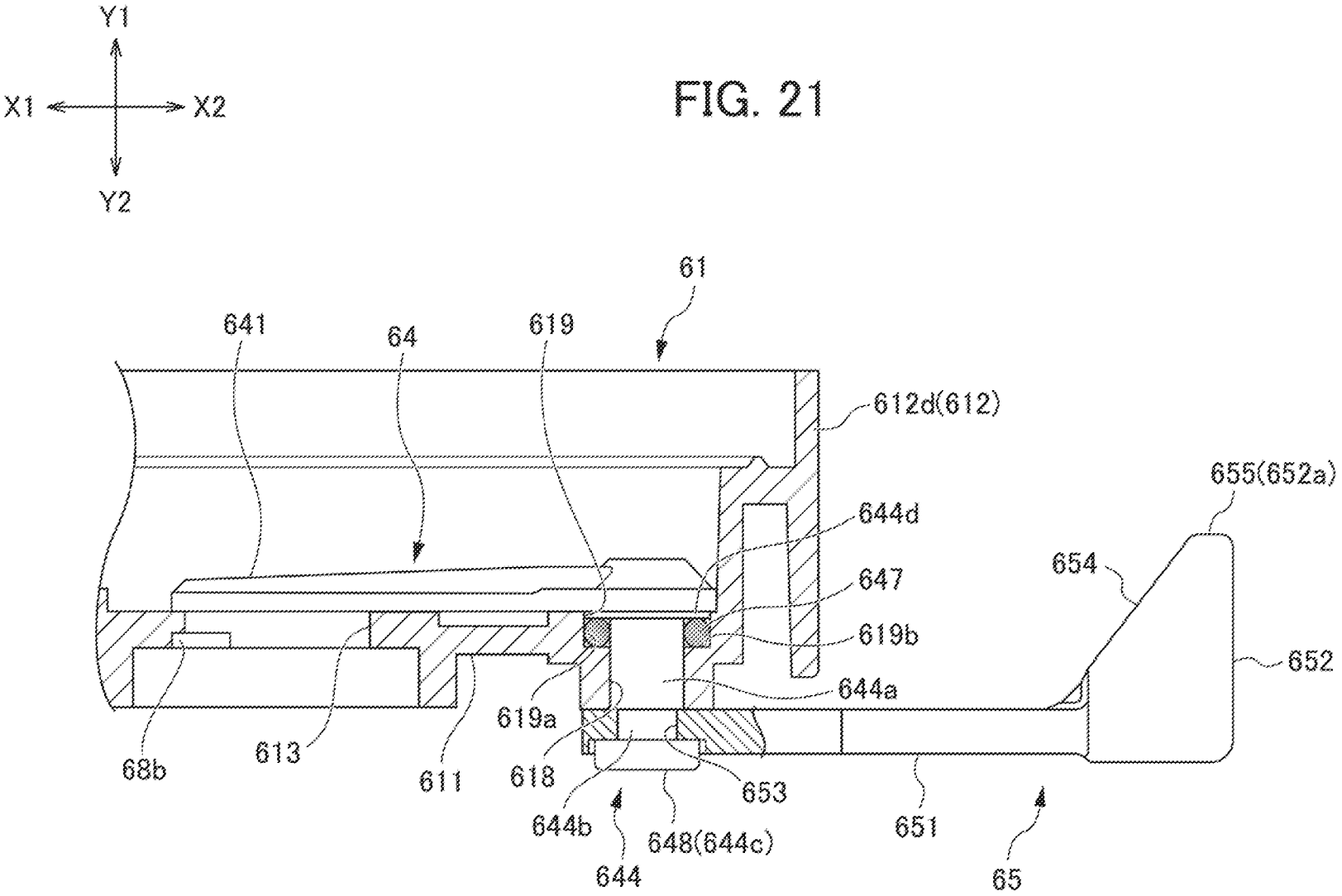
FIG. 21 is a cross-sectional view showing a mounting structure of the opening/closing member and working member in the intake member according to an embodiment of the present invention.

Next, the mounting structure of the choke valve 64 and choke lever 65 will be further explained by referencing FIG. 21. FIG. 21 is a cross-sectional view showing the mounting structure of the opening/closing member and working member in the intake member according to the embodiment of the present invention. FIG. 21 shows a transverse sectional view when viewing the air cleaner case 61 from a lower side, and illustration of the guide hole 66 is omitted. The choke valve 64 is mounted so as to run along the end wall 611, from a surface on the air filter 62 side of the end wall 611 of the air cleaner case 61. In detail, the engaging shaft 644 of the choke valve 64 is inserted via the O-ring 647 to the mounting hole 618 provided in the end wall 611, and the valve body plate 641 is arranged so as to cover the opening 613, or be in the vicinity of the opening 613. This O-ring 647 is one embodiment of an elastic member.

The inside diameter of the mounting hole 618 is substantially equal to the outside diameter of the first columnar part 644*a* of the engaging shaft 644 of the choke valve 64. At the end part on the air filter 62 side of the mounting hole 618, an accommodating step part 619 which accommodates the O-ring 647 installed at the outer circumference of the engaging shaft 644 is provided so as to be a slightly larger diameter than the mounting hole 618. The inside diameter of the accommodating step part 619 is slightly smaller than the outside diameter of the O-ring 647 installed at the outer circumference of the engaging shaft 644. For this reason, when the engaging shaft 644 of the choke valve 64 is inserted in a mounting hole 618, the O-ring 647 elastically abuts to seal the inner circumferential wall surface 619*a* of this accommodating step part 619, and elastically abuts to seal the bottom surface 619*b* of the accommodating step part 619. The O-ring 647 is thereby sandwiched between a pedestal part 644*d* of the choke valve 64 and the bottom surface 619*b* of the accommodating step part 619. By the sealing action of this O-ring 647, dirt, etc. is prevented from flowing from the side of the air filter 62 through the opening 613 to the side of the carburetor 60.

The mounting hole 618 is arranged somewhat above the through hole 614*b* provided in the end wall 611. The connecting plate 643 of the choke valve 64 has a convex curved part 643*a* which is smoothly recessed so as to avoid this through hole 614*b*, as shown in FIG. 16. For this reason, even if arranging the choke valve 64 in the vicinity of the through hole 614*b*, it becomes possible to make compact the air cleaner case 61, without the choke valve 64 interfering with the through hole 614*b*.

On the other hand, the choke lever 65 is mounted to a surface on the opposite side to the air filter 62 of the end wall 611, by the arm part 651 being inserted from the guide hole 66 of the air cleaner case 61. At a surface on the opposite side to the air filter 62 of the end wall 611 of the air cleaner case 61, the square column part 644*b* and second columnar part 644*c* of the engaging shaft 644 of the choke valve 64 project from the mounting hole 618, and fit together with the engaging hole 653 of this choke lever 65, by inserting the square column part 644*b* of the engaging shaft 644 projecting from the mounting hole 618. The size (inside dimension) of the engaging hole 653 is formed to be slightly smaller than the size (outside dimension) of the square columnar part 644*b*. For this reason, the engaging hole 653 and square columnar part 644*b* engage by being lightly press fit.

When the engaging shaft 644 of the choke valve 64 is pressed towards the mounting hole 618, and further press fit to the engaging hole 653 of the choke lever 65, the O-ring 647 is further crushed between the pedestal part 644*d* and bottom surface 619*b* of the accommodating step part 619, and the second columnar part 644*c* of the engaging shaft 644 projects from the engaging hole 653. In this state, the choke valve 64 and choke lever 65 are integrally linked by thermal caulking the second columnar part 644*c* projecting from the engaging hole 653 and forming a caulking part 648. At this time, the O-ring 647 exhibiting elastic resiliency along the axial direction (Y1-Y2 direction) of the engaging shaft 644, between the pedestal part 644*d* of the choke valve 64 and the bottom surface 619*b* of the accommodating step part 619, reduces the rattling between the choke valve 64, choke lever 65 and end wall 611.

The opening/closing mechanism 6A consisting of the choke valve 64 and the choke lever 65 mounted to the air cleaner case 61 open/close the opening 613 of the air cleaner case 61, by the holding part 652 of the choke lever 65 being held by the hand (finger) of the operator and manipulated to move along the guide hole 66.

Figure 22:
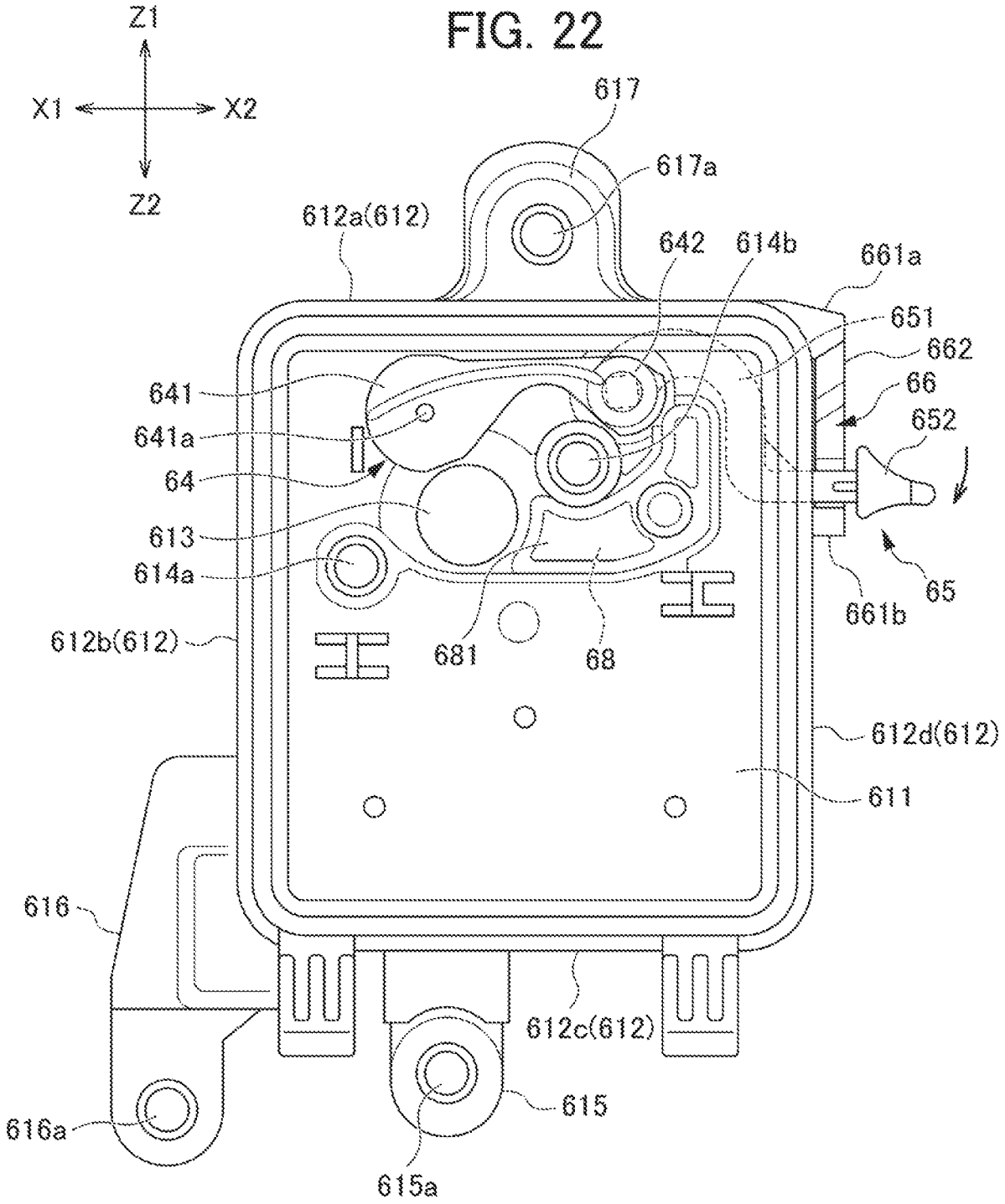
FIG. 22 is a view showing a state opening the opening in the intake member according to an embodiment of the present invention.
Figure 23:
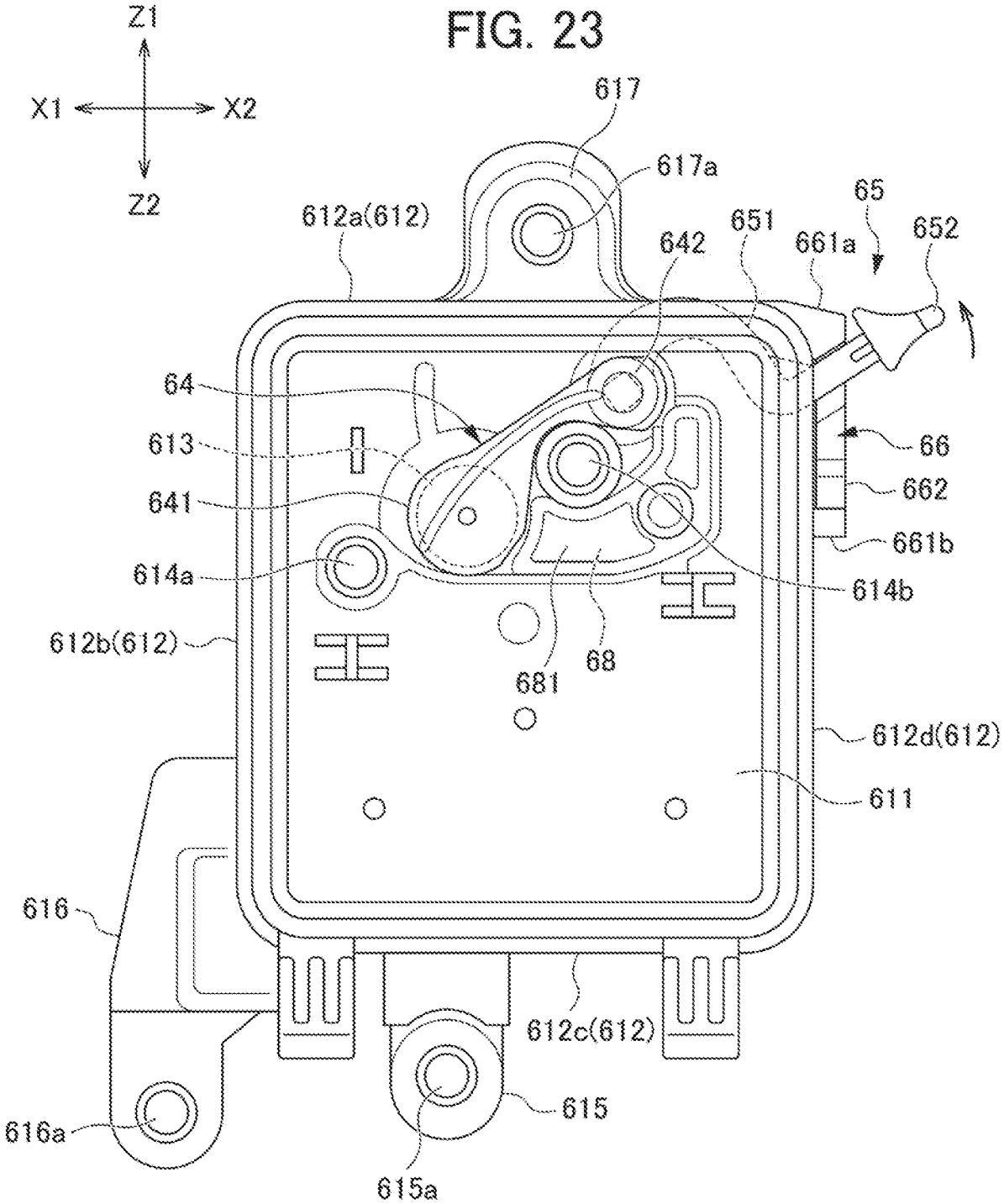
FIG. 23 is a view showing a state closing the opening in the intake member according to an embodiment of the present invention.
Figure 24:
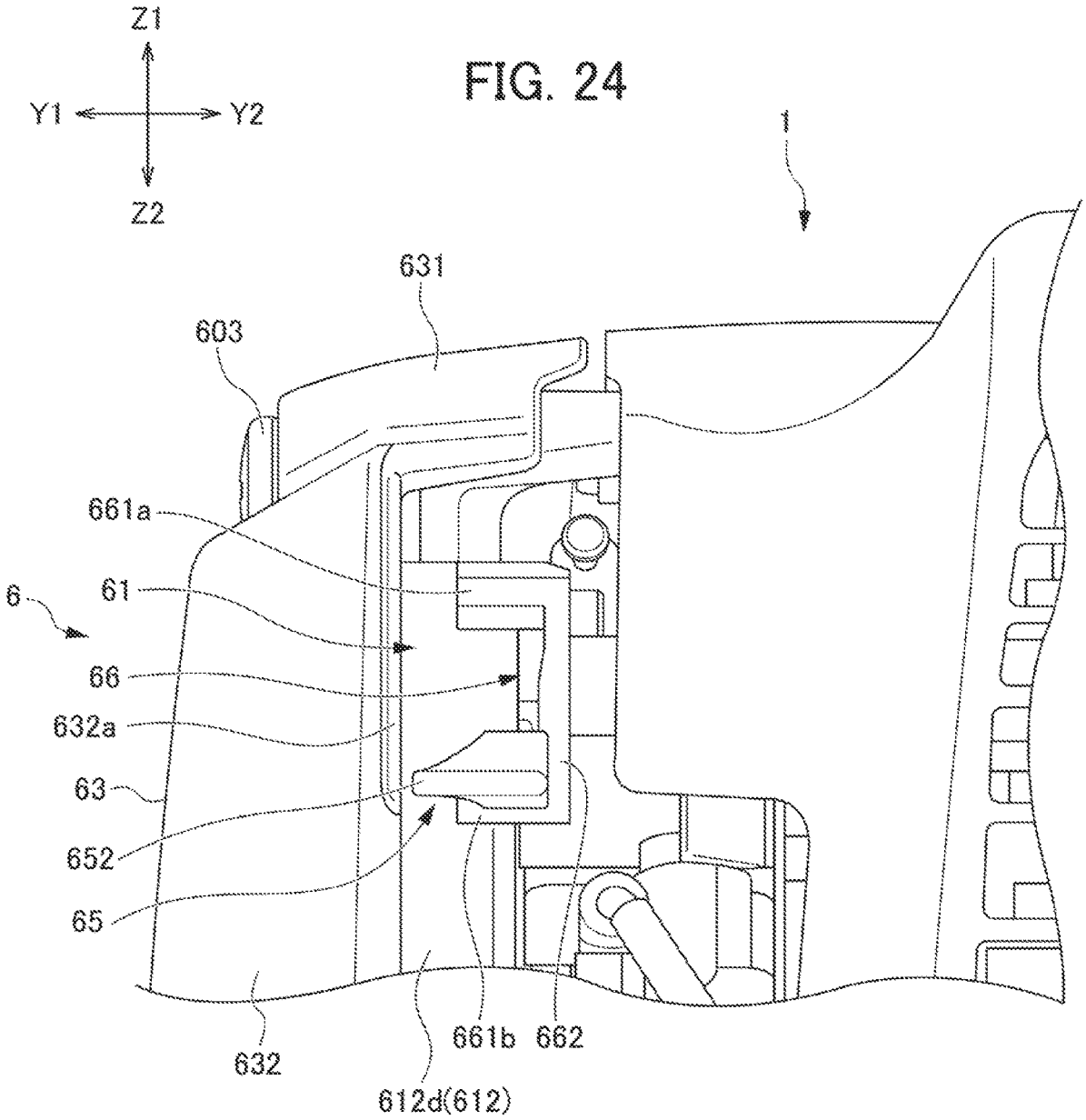
FIG. 24 is a view showing the position of the working member upon opening the opening in the intake member according to an embodiment of the present invention.
Figure 25:
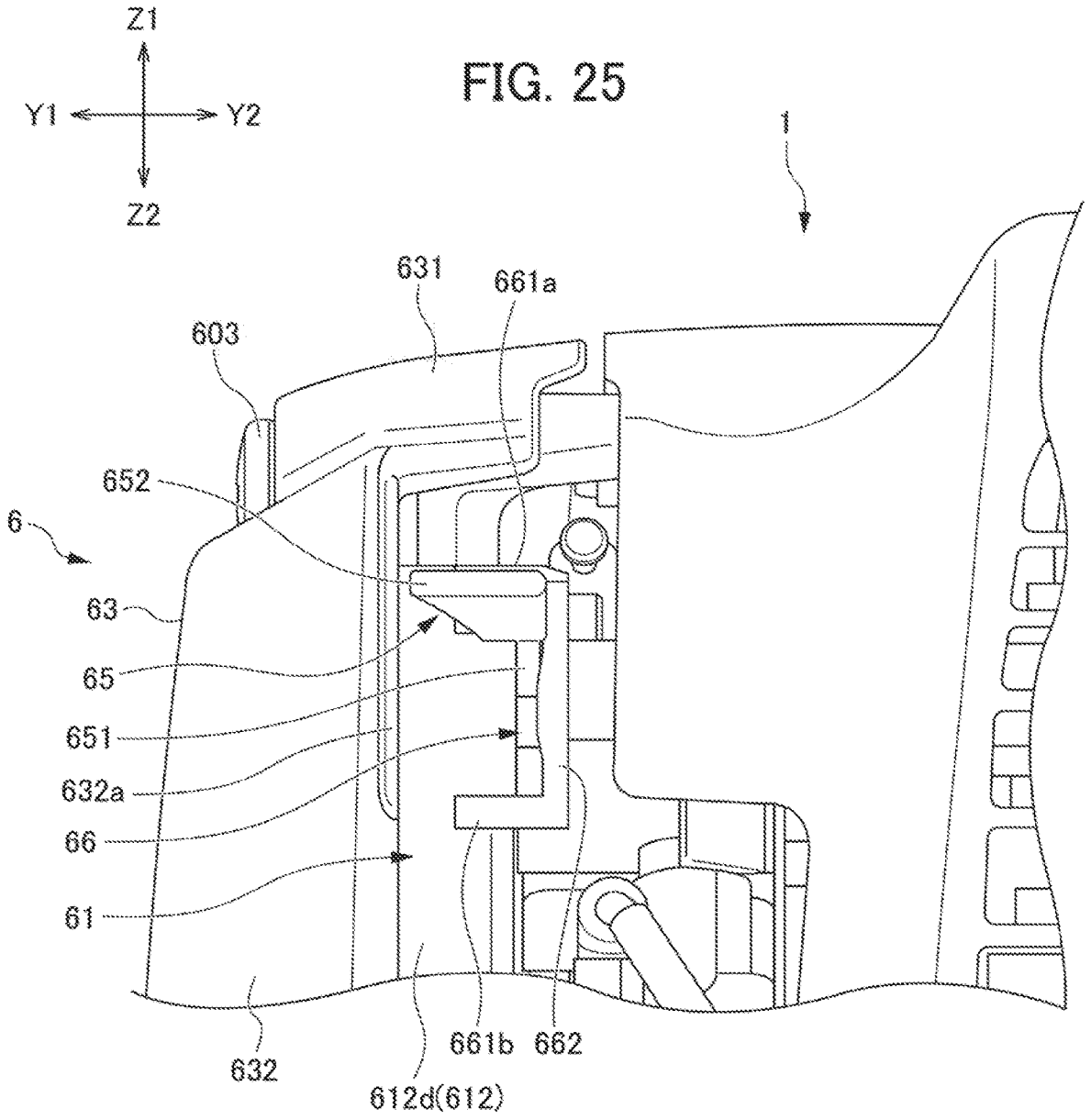
FIG. 25 is a view showing the position of the working member upon closing the opening in the intake member according to an embodiment of the present invention.
Figure 26:
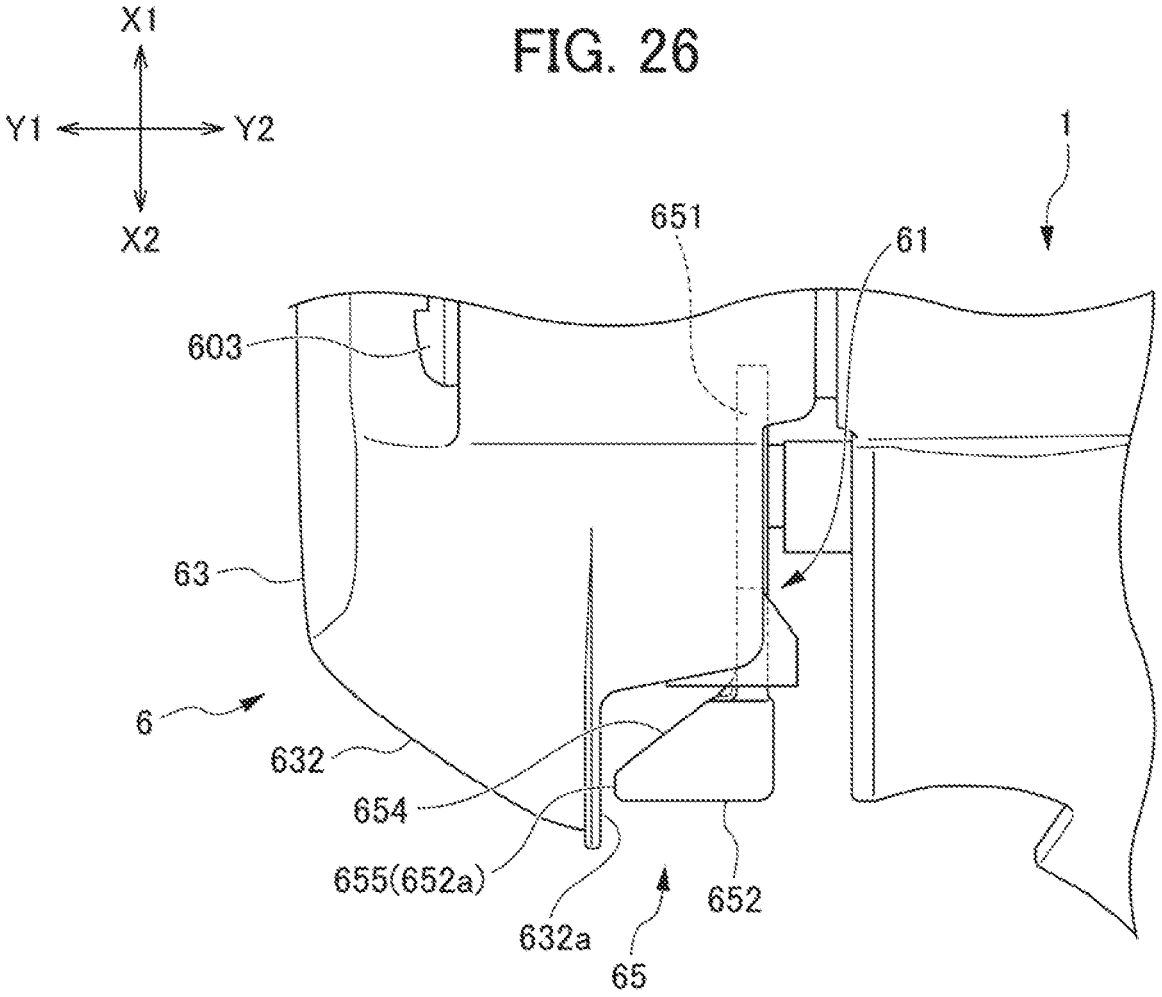
FIG. 26 is a plan view showing the arrangement relationship between the working member and a covering part according to an embodiment of the present invention.

Herein, the opening/closing operation of the opening 613 by way of the opening/closing mechanism 6A of the present embodiment will be further explained using FIGS. 22 to 26. FIG. 22 is a view showing a state opening the opening of the intake member according to an embodiment of the present invention. FIG. 23 is a view showing a state closing the opening of the intake member according to an embodiment of the present invention. FIG. 24 is a view showing the position of a working member when opening the opening of the intake member according to an embodiment of the present invention. FIG. 25 is a view showing the position of the working member when closing the opening of the intake member according to an embodiment of the present invention. FIG. 26 is a plan view showing an arrangement relationship between the working member and the covering part according to an embodiment of the present invention.

As shown in FIGS. 22 and 24, when the choke lever 65 is manipulated to move downwards so that the holding part 652 is arranged at the lower end of the guide hole 66, the valve body plate 641 side of the choke valve 64 rotates upwards around the engaging shaft 644, the valve body plate 641 moves above the opening 613, and causes the opening 613 to open (opened state). The opening 613 is thereby completely opened, intake air purified by passing through the air filter 62 is sent to the intake opening 60*a* of the carburetor 60 through the opening 613, and the fuel ratio relative to intake air is made to decline. The positions of the choke valve 64 and choke lever 65 at this time are positions during normal running of the all-purpose engine 1.

On the other hand, as shown in FIGS. 23 and 25, when the choke lever 65 is manipulated to move upwards so that the holding part 652 is arranged at the upper end of the guide hole 66, the valve body plate 641 side of the choke valve 64 rotates downwards around the engaging shaft 644, and the valve body plate 641 moves so as to cover the opening 613 to make the opening 613 blocked (closed state). The opening 613 is thereby substantially closed, intake air which was purified by passing through the air filter 62 is simply sent to the intake opening 60*a* of the carburetor 60 from the small-diameter hole 641*a* in the valve body plate 641 through the opening 613, which causes the fuel ratio relative to intake air to increase. The positions of the choke valve 64 and choke lever 65 at this time are positions during starting of the all-purpose engine 1.

Herein, since the holding part 652 of the choke lever 65 has the planar section 655, as shown in FIG. 26, even if arranging the cover 63 close to the side of the air cleaner case 61, it is possible to secure a clearance between the holding part 652 and the flange part 632*a* projecting from the cover main body 632 of the cover 63, and thus it is possible to avoid interference between the flange part 632*a* of the cover 63 and the holding part 652. For this reason, the cover 63 becomes able to be brought as close as possible to the air cleaner case 61, and it becomes possible to make the air cleaner 6 and all-purpose engine 1 compact. Moreover, even if the holding part 652 has the notch part 654, by the end part on the cover 63 side thereof being established as the planar section 655 without an acute angle, even if holding and manipulating the holding part 652 by hand (finger), the choke lever 65 becomes superior in operability without giving an uncomfortable impression to the operator. In addition, by the thin part of the leading end which does not function much as the holding part 652 being cut off to establish the planar section 655, both the maintaining of operability and compactness are achieved.

Figure 27:
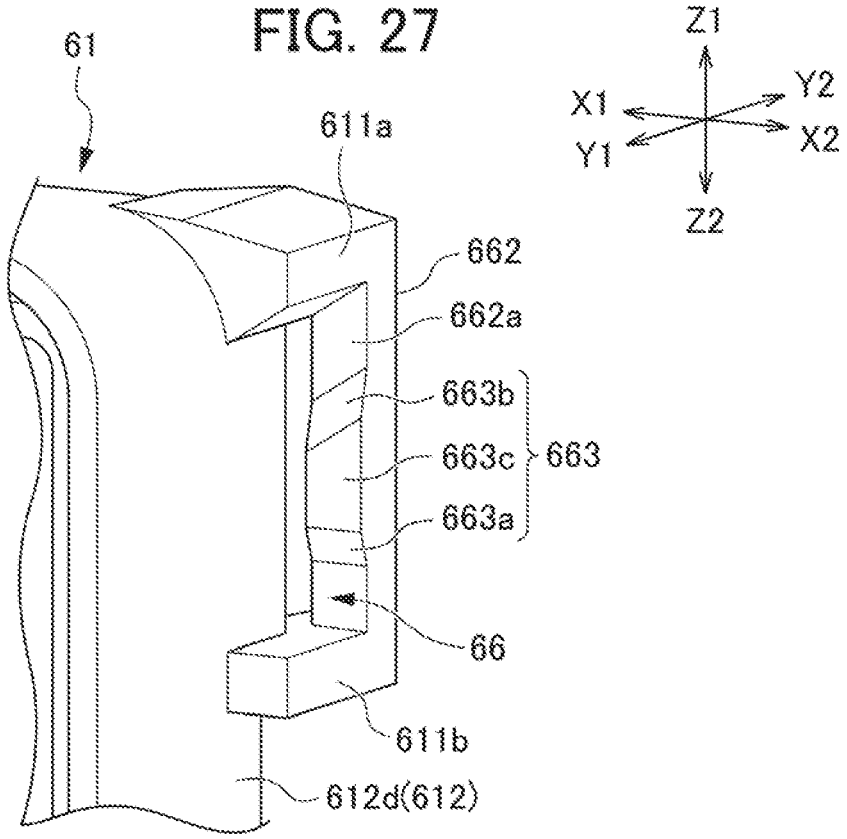
FIG. 27 is a perspective view showing a guide hole of the intake member according to an embodiment of the present invention to be enlarged.
Figure 28:
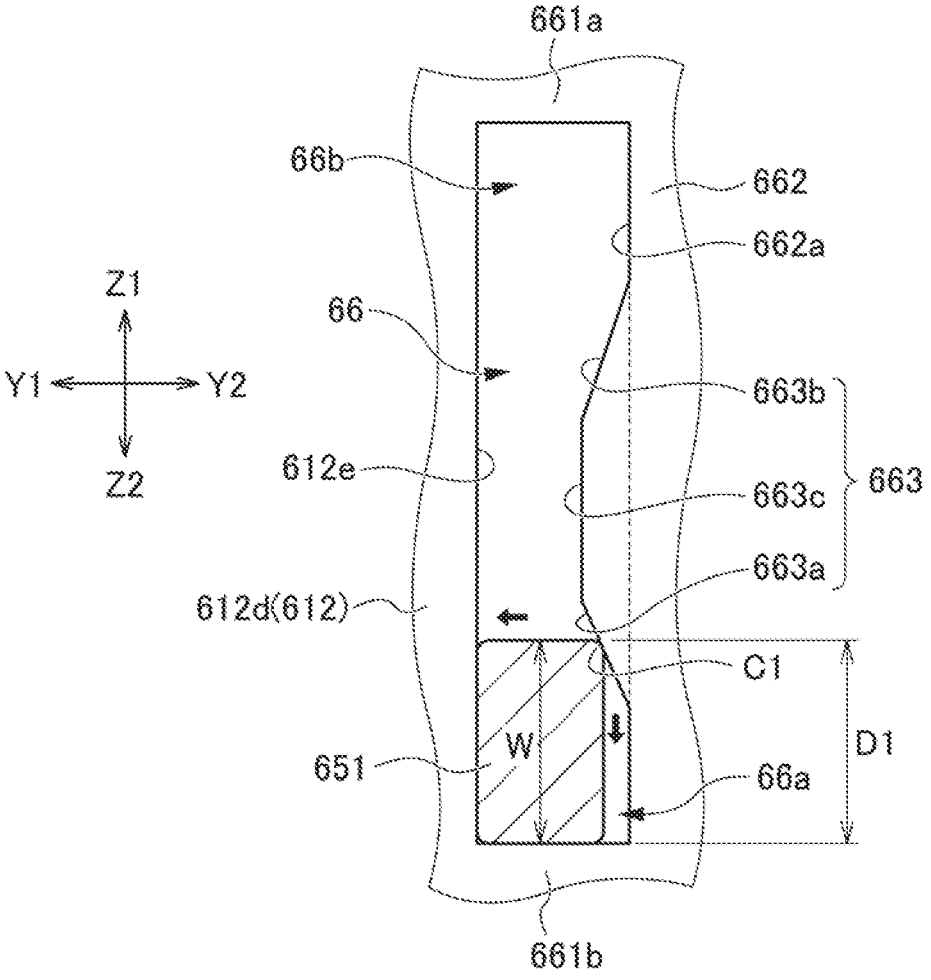
FIG. 28 is a view showing the position of an arm part of the working member in a state opening the opening of the guide hole in the intake member according to an embodiment of the present invention.
Figure 29:
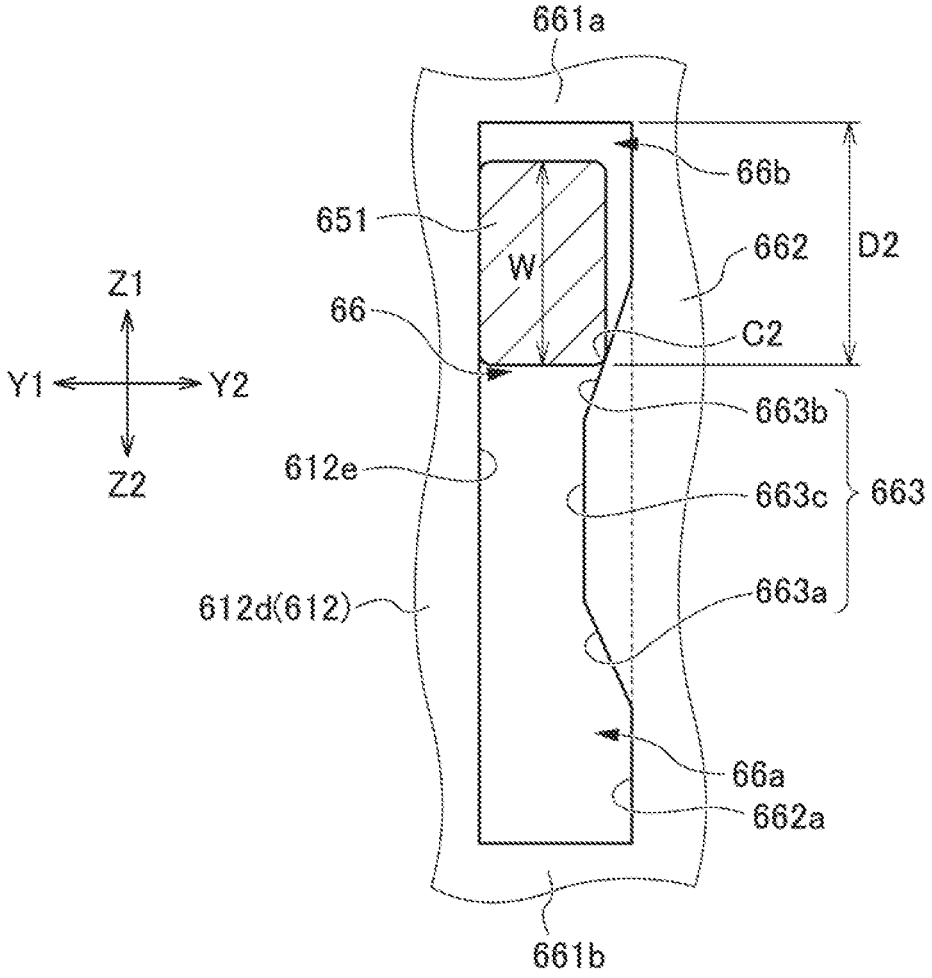
FIG. 29 is a view showing the position of an arm part of the working member in a state closing the opening of the guide hole in the intake member according to an embodiment of the present invention.

Herein, the guide hole 66 will be described in further detail by referencing FIGS. 27 to 29. FIG. 27 is a perspective view showing the guide hole of the intake member according to an embodiment of the present invention to be enlarged. FIG. 28 is a view showing the position of the arm part of the working member in a state opening the opening of the guide hole in the intake member according to an embodiment of the present invention. FIG. 29 is a view showing the position of the arm part of the working member in a state blocking the opening of the guide hole in the intake member according to an embodiment of the present invention. In the guide hole 66 of the present embodiment, the side at which the arm part 651 is located upon establishing the opening 613 in the closed state is the upper side in the gravity direction (Z1 direction side), and the side at which the arm part 651 is located upon establishing the opening 613 in the opened state is the lower side in the gravity direction (Z2 direction side). For this reason, it is possible to manipulate the choke lever 65 to move simply with a natural action. This guide hole 66 has a positioning protrusion 663 which positions the arm part 651 of the choke lever 65 inside of the guide hole 66, at the inside surface 662*a* (surface on Y1 direction side) of the crossover frame part 662.

The positioning protrusion 663 is provided so as to gently project from the inside surface 662*a* of the crossover frame part 662. In detail, the positioning protrusion 663 has: a first sloped part 663*a* which positions the arm part 651 of the choke lever 65 at the lower end (opened state) of the guide hole 66; a second sloped part 663*b* which positions the arm part 651 of the choke lever 65 at the upper end (closed sate) of the guide hole 66; and a flat part 663*c* which links this first sloped part 663*a* and second sloped part 663*b*. The sloping angle of the second sloped part 663*b* is gently formed compared to the sloping angle of the first sloped part 663*a*. In addition, the projecting height (height of flat part 663*c* from the inside surface 662*a* of the crossover frame part 662) of the positioning protrusion 663 is somewhat larger than a value arrived at by subtracting the thickness of the arm part 651 (thickness in Y1-Y2 direction) from the width (width in Y1-Y2 direction) of the guide hole 66.

As shown in FIG. 28, when the choke lever 65 is manipulated to move to the opened state and the arm part 651 abuts the movement direction restricting part 661*b* on the lower side, the arm part 651 is accommodated in a lower space 66*a* within the guide hole 66 surrounded by the movement direction restricting part 661*b*, inside surface 662*a* of the crossover frame part 662 and side edge part 612*e* of the rear side wall 612*d*. At this time, the first sloped part 663*a* abuts with a corner part C1 above the arm part 651 and on the inner side (carburetor 60 side, Y2 direction side), and is arranged so as to press the arm part 651 towards the movement direction restricting part 661*b* on the lower side and the side edge part 612*e* of the rear side wall 612*d*, as shown by the arrows in the drawing. In other words, in the lower space 66*a*, the relationship between the distance D1 from the abutting part of the first sloped part 663*a* and arm part 651 until the movement direction restricting part 661*b* on the lower side, and the width W along the movement direction (Z1-Z2 direction) of the arm part 651 becomes D1W.

The arm part 651 of the choke lever 65 is thereby firmly retained and positioned by the first sloped part 663*a*, movement direction restricting part 661 on the lower side and the side edge part 612*e* of the rear side wall 612*d*. For this reason, while the choke lever 65 is being manipulated to move to the opened state, by the choke lever 65 moving within the guide hole 66 and being limited by friction, without the choke lever 64 rattling by the vibrations, etc. during normal running of the all-purpose engine 1, it is possible to suppress rattling from occurring at the arm part 651 and abnormal noise from generating, and the choke valve 64 moving and the running state becoming unstable.

Moreover, the choke lever 65 is fixed to be positioned firmly at two points by engaging to the choke valve 64 without rattling in the engaging hole 653, and positioning the arm part 651 without rattling by the lower space 66*a* of the guide hole 66; therefore, unstable elements in the mounting state of the choke lever 65 is eliminated to the utmost, and it is possible to greatly improve the reliability of the opening/closing mechanism 6A.

On the other hand, as shown in FIG. 29, upon the choke lever 65 being manipulated to move to the closed state, and the arm part 651 abutting the movement direction restricting part 661*a* on the upper side, the arm part 651 is accommodated in the upper space 66*b* within the guide hole 66 surrounded by the movement direction restricting part 661*a*, inside surface 662*a* of the crossover frame part 662 and the side edge part 612*e* of the rear side wall 612*d*.

Herein, the size of the guide hole 66 in the movement direction (Z1-Z2 direction) of the arm part 651 differs between the side at which the arm part 651 is located upon establishing the opening 613 in the closed state (upper space 66*b*), and the side at which the arm part 651 is located upon establishing the opening 613 in the opened state (lower space 66*a*), relative to the positioning protrusion 663. In the present embodiment, the upper space 66*b* is formed to be larger than the lower space 66*a*. In other words, as shown in FIG. 29, in a state in which the corner C2 which is below the arm part 651 arranged at the lower space 66*a* and on the inner side (carburetor 60 side, Y2 direction side) abuts the second sloped part 663*b*, and the arm part 651 abuts the side edge part 612*e* of the rear side wall 612*d*, the relationship between the distance D2 from the abutting part of the second sloped part 663*b* and the corner C2 of the arm part 651 until the movement direction restricting part 661*a* on the upper side, with the width W along the movement direction (Z1-Z2 direction) of the arm part 651 becomes D2>W.

For this reason, the second sloped part 663*b* causes almost no pressing force towards the movement direction restricting part 661*a* and the side edge part 612*e* of the rear side wall 612*d* to act on the arm part 651, compared to the first sloped part 663*a*. In other words, the arm part 651 arranged in the upper space 66*b* is positioned to be loosely clamped compared to a case of being arranged in the lower space 66*a*. At this time, the choke lever 65 maintains the position of the closed state, by the elastic force of the resin, engaging force with the choke valve 64, etc. in addition to the loose clamping force by the guide hole 66. This closed state is a temporary state during starting of the all-purpose engine 1, and due to the frequency of use being very low compared to the opened state, a hinderance will not occur in the running of the all-purpose engine 1 even if not positioning the arm part 651 firmly.

It should be noted that, upon the arm part 651 of the choke lever 65 moving vertically within the guide hole 66, the arm part 651 passes through the flat part 663*c* of the positioning protrusion 663. This flat part 663*c* is a part at which the width of the guide hole 66 (width in Y1-Y2 direction) is smaller than the thickness of the arm part 651 (thickness in Y1-Y2 direction); however, the crossover frame part 662 is made of resin, and is easily deformable accompanying movement of the arm part 651; therefore, there is no concern over hindering the movement of the arm part 651.

In addition, the positioning protrusion 663 can also be provided to the side edge part 612*e* of the rear side wall 612*d* or the arm part 651, instead of providing to the inside surface 662*a* of the crossover frame part 662. However, by providing to the crossover frame part 662 which tends to deflect and deform compared to the rear side wall 612*d* as in the present embodiment, it is possible to further improve the operability of the choke lever 65.

Figure 30:
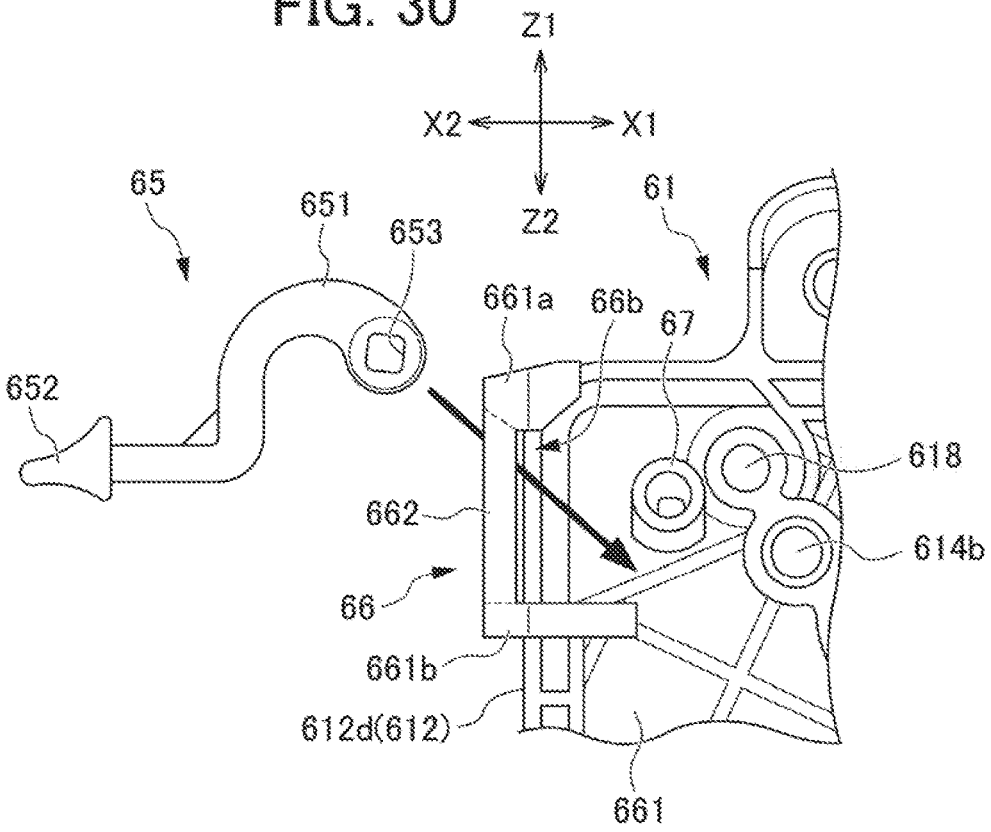
FIG. 30 is a view illustrating a step upon attaching the working member to the guide hole of the intake member according to an embodiment of the present invention.
Figure 31:
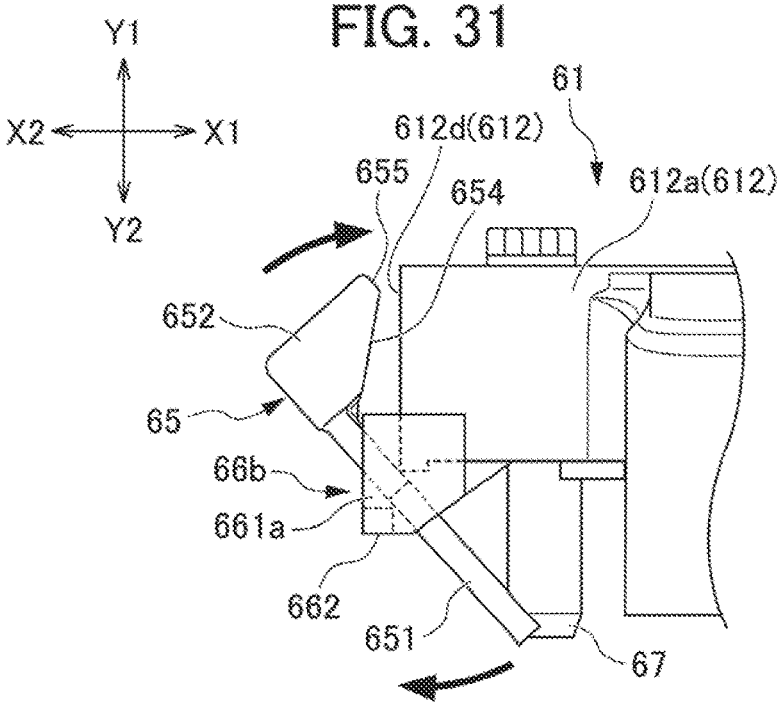
FIG. 31 is a view illustrating a step upon mounting the working member to the guide hole of the intake member according to an embodiment of the present invention.
Figure 32:
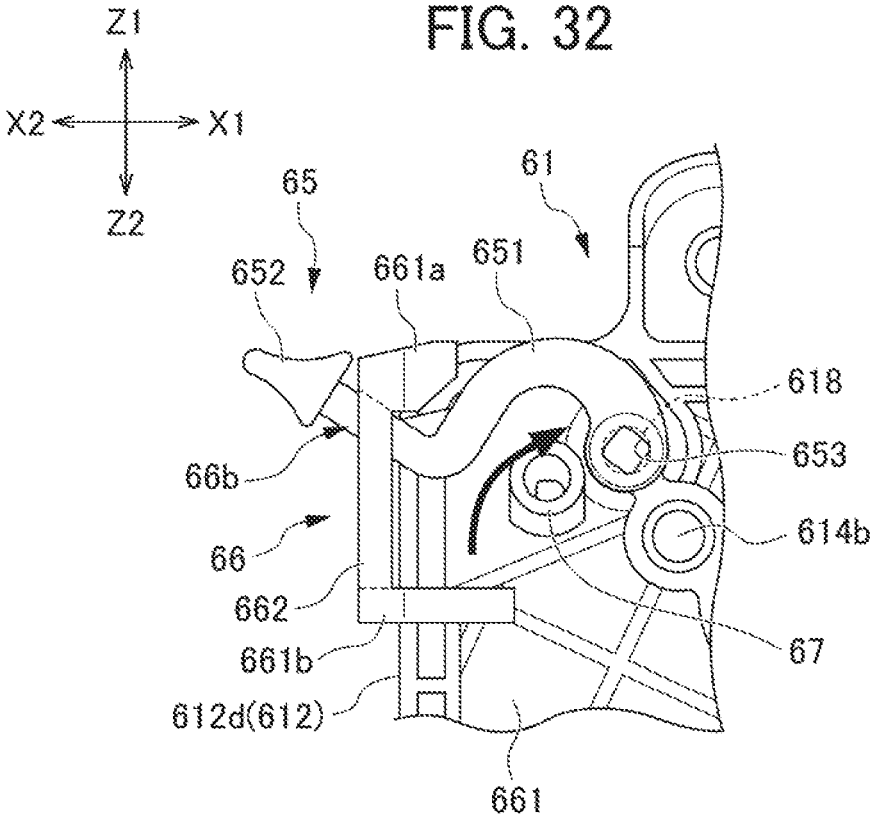
FIG. 32 is a view illustrating a step upon attaching the working member to the guide hole of the intake member according to an embodiment of the present invention.

Next, a specific method of inserting the arm part 651 of the choke lever 65 into the guide hole 66 will be explained by referencing FIGS. 30 to 32. FIGS. 30 to 32 are views respectively illustrating steps upon mounting the working member to the guide hole of the intake member according to an embodiment of the present invention. In the present embodiment, the choke lever 65 is mounted to the air cleaner case 61 by inserting the arm part 651 into the guide hole 66.

Herein, upon inserting the arm part 651 into the guide hole 66, it is possible to perform using the upper space 66*b* within the guide hole 66. This is because the upper space 66*b* is formed to be larger than the lower space 66*a* which firmly holds and positions the arm part 651. In other words, D1<D2. Since the upper space 66*b* is the side of little usage frequency, it is possible to make the arm part 651 of the choke lever 65 to easily insert into the guide hole 66, while minimizing the work influence, and it is possible to improve the mounting property of the choke lever 65. Since the side of the upper space 66*b* of little usage frequency in the guide hole 66 is larger than the side of the lower space 66*a*, it is possible to clamp in a state positioning the arm part 651 of the choke lever 65 during normal use of large usage frequency within the guide hole 66, while improving the mounting property of the choke lever 65.

First, as shown in FIGS. 13 to 15, and 30 to 32, the cylindrical boss part 67 which greatly projects towards the side of the carburetor 60 (opposite side to the air filter 62; Y2 direction side) is provided to the end wall 611 of the air cleaner case 61. The boss part 67 constitutes a passage for sending a gas including oil blown back from the carburetor 60 to the side of the air filter 62 via the opening 613, to the intake opening 60*a* of the carburetor 60 again through the opening 613. In detail, the boss part 67 of the present embodiment is provided to the end wall 611 between the guide hole 66 and opening 613, above the center of the opening 613 in the gravity direction (Z1-Z2 direction) of the air cleaner case 61.

On the surface of the end wall 611 on the side of the air filter 62, a communication passage 68 constituting a passage for sending a gas containing oil to the intake opening 60*a* of the carburetor 60 together with the boss part 67 is provided to be recessed, as shown in FIG. 15. The communication passage 68 has one end 68*a* communicating with the boss part 67, and the other end 68*b* communicating with the opening 613. The communication passage 68 extends downwards from the one end 68*a* communicating with the boss part 67, and extends towards the side of the opening 613 in substantially the same height as the opening 613. The other end 68*b* of the communication passage 68 communicates more with the opening 613 at the side of the carburetor 60 (Y2 direction side) more than the closed surface by the valve body plate 641 of the choke lever 64, as shown in FIGS. 15 and 21. The communication passage 68 is blocked by a passage cover 681 over the entire length and isolated from the air filter 62, as shown in FIGS. 12, 22 and 23; therefore, the air filter 62 will not be contaminated by the air-fuel mixture blown back from the side of the carburetor 60.

The boss part 67, by being arranged above the opening 613 in the gravity direction, can guide oil included in the gas from the side of the carburetor 60 to the opening 613 by the action of gravity. In the present embodiment, the boss part 67, due to being arranged between the guide hole 66 and opening 613, will not interfere during opening/closing movement of the valve body plate 651 of the choke valve 64, and further, it is possible to form the air cleaner case 61 compactly.

However, upon inserting the arm part 651 of the choke lever 65 from the guide hole 66, and arranging the engaging hole 653 at the mounting hole 618, the arm part 651 will interfere with the boss part 67. For this reason, the arm part 651 of the choke lever 65 is inserted more downwards than the boss part 67 (FIG. 30), so as to avoid the boss part 67 upon first being inserted along the end wall 611 from the upper space 66*b* of the guide hole 66.

Next, the side of the holding part 652 of the choke lever 65 inclined towards the rear side wall 612*d*. The side of the one end 651*c* of the arm part 651 is greatly inclined so as to project to the side of the carburetor 60 (Y2 direction side) (FIG. 31). The crossover frame part 662 forming the guide hole 66 is shifted more to the rear side (X2 direction side) than the rear side wall 612*d* of the air cleaner case 61; therefore, the side edge part 612*e* of the rear side wall 612*d* and the inside surface 662*a* of the crossover frame part 662 do not oppose to interpose the arm part 651. For this reason, it is possible to easily incline the side of the holding part 652 of the choke lever 65 towards the rear side wall 612*d*. At this time, the notch part 654 of the holding part 652 becomes substantially parallel to the rear side wall 612*d*; therefore, it is possible to greatly slope the arm part 651 to an extent which can overcome the boss part 67, without the holding part 652 and the rear side wall 612*d* interfering. Therefore, according to this opening/closing mechanism 6A, it is possible to greatly improve the mounting property of the choke lever 65.

Furthermore, at the same time as inclining the side of the holding part 652 of the choke lever 65 towards the rear side wall 612*d*, the side of the holding part 652 is made to move so as to rotate downwards around a clamping section of the arm part 651 and guide hole 66 (FIG. 32). The arm part 651 thereby surpasses the boss part 67 to be arranged above the boss part 67, and the engaging hole 653 is arranged so as to match the mounting hole 618. At this time, since a bend section 651*a* of the arm part 651 is arranged above the boss part 67, it is possible to accommodate the boss part 67 on the inner side of the bend section 651*a*, and the boss part 67 will not interfere during a moving manipulation of the choke lever 65.

It should be noted that the present invention is not to be limited to the above-mentioned embodiment, and that modifications and improvements within a scope which can achieve the objects of the present invention are encompassed by the present invention. For example, in the present embodiment, the engaging shaft 644 is provided to the choke valve 64, and the engaging hole 653 is provided to the choke lever 65; however, the engaging shaft may be provided to the arm part 651 of the choke lever 65, and the engaging hole may be provided to the linking plate 642 of the choke valve 64.

EXPLANATION OF REFERENCE NUMERALS

6 air cleaner
6A opening/closing mechanism
60 carburetor
61 air cleaner case (intake member)
611 end wall
612*d* rear side wall (side wall of intake member)
613 opening
618 mounting hole
619 accommodating step part
62 air filter (filter part)
63 cover (covering part)
64 choke valve (opening/closing member)
644 engaging shaft
647 O-ring (elastic member)
65 choke lever (working member)
651 arm part
651*c* one end (of arm part)
651*d* other end (of arm part)
652 holding part
652*a* side end (of holding part)
653 engaging hole
653 notch part
655 planar section
66 guide hole
661 movement direction restricting part
662 crossover frame part
662*a* inside surface (of crossover frame part)
663 positioning protrusion
67 boss part
68 communication passage

The invention claimed is:

1. An opening/closing mechanism, comprising:

an intake member which accommodates a filter part and has an opening leading to a carburetor in an end wall opposing the filter part;

an opening/closing member which is disposed between the filter part and the end wall, and opens/closes the opening; and a working member which is disposed on an opposite side to the opening/closing member so as to interpose the end wall between the working member and the opening/closing member, and allows the opening/closing member to be operated, wherein the working member includes: an arm part which extends along the end wall and is linked with the opening/closing member to interpose the end wall at one end part, and a holding part provided to another end part of the arm part, wherein the intake member has a guide hole into which the arm part is inserted and which guides movement of the arm part, and wherein the holding part is disposed to project out of the guide hole, is provided to be wider than the arm part, extends from the arm part towards a side opposite to the carburetor, and has a notch part at a surface opposing a side wall of the intake member, wherein the notch part is obliquely notched out so as to gradually become a narrow shape extending toward a linking part with the arm part.

2. The opening/closing mechanism according to claim 1, wherein a covering part which covers an outer side of the intake member is disposed at an opposite side to the end wall so as to interpose the filter part between the end wall and the covering part, and wherein the holding part has a planar section which is continuous with the notch part, at a side end opposing the covering part.

3. The opening/closing mechanism according to claim 1, wherein the guide hole has a positioning protrusion which positions the arm part to clamping upon establishing the opening in an opened state.

4. The opening/closing mechanism according to claim 3, wherein the guide hole is formed by an internal space surrounded by two movement direction restricting parts which project to an opposite side than the filter part to interpose the end wall from the intake member and restrict positions of both ends in a movement direction of the arm part, and one crossover frame part which is provided to span the two movement direction restricting parts, and wherein the positioning protrusion is provided at an inner surface of the crossover frame part.

5. The opening/closing mechanism according to claim 3, wherein the guide hole has a different size at a side on which the arm part is located upon establishing the opening in a closed state than at a side on which the arm part is located upon establishing the opening in an opened state, relative to the positioning protrusion.

6. The opening/closing mechanism according to claim 5, wherein the size of the guide hole is larger at a side on which the arm part is located upon establishing the opening in the closed state than a side on which the arm part is located upon establishing the opening in the opened state.

7. The opening/closing mechanism according to claim 5, wherein a side of the guide hole on which the arm part is located upon establishing the opening in the closed state is an upper side in a gravity direction, and a side on which the arm part is located upon establishing the opening in the opened state is a lower side in the gravity direction.

8. The opening/closing mechanism according to claim 1, wherein the opening/closing member or the working member has an engaging shaft which engages with the end wall via an elastic member, wherein the engaging shaft penetrates a mounting hole of the end wall and is inserted to an engaging hole provided in the working member or the opening/closing member, and wherein the elastic member is elastically sandwiched between an accommodating step part provided to the mounting hole and the opening closing member or the working member.

9. The opening/closing mechanism according to claim 1, wherein the intake member has a cylindrical boss part which projects to an opposite side than the filter part to interpose the end wall, and constitutes a passage that returns a gas returned from a side of a carburetor to the carburetor via the opening, and wherein the boss part is provided above the opening in the gravity direction of the intake member.

* * * * *